US008422893B2

(12) United States Patent
Kim et al.

(10) Patent No.: US 8,422,893 B2
(45) Date of Patent: Apr. 16, 2013

(54) DEVELOPER AND IMAGE FORMING APPARATUS INCLUDING THE SAME

(75) Inventors: Jong-in Kim, Suwon-si (KR); Dae-seob Kweon, Suwon-si (KR); Sang-hoon Lee, Suwon-si (KR); Won-il Cho, Seongnam-si (KR); Yoon-tae Lee, Seoul (KR); Jae-sung Lee, Hwaseong-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 155 days.

(21) Appl. No.: 12/872,080

(22) Filed: Aug. 31, 2010

(65) Prior Publication Data

US 2011/0176817 A1 Jul. 21, 2011

(30) Foreign Application Priority Data

Jan. 21, 2010 (KR) ..... 10-2010-0005758
Jan. 25, 2010 (KR) ..... 10-2010-0006500
Jul. 21, 2010 (KR) ..... 10-2010-0070473

(51) Int. Cl.
*G03G 15/00* (2006.01)

(52) U.S. Cl.
USPC ..... 399/12; 399/120; 399/360

(58) Field of Classification Search ..... 399/12, 399/343, 350, 351, 358, 360, 107, 111, 119, 399/120
See application file for complete search history.

(56) References Cited

U.S. PATENT DOCUMENTS 6,622,001 B2 * 9/2003 Arimitsu et al. ..... 399/358
2003/0161644 A1 8/2003 Yokoi et al.
2004/0114959 A1 6/2004 Daniels
2004/0258441 A1 12/2004 Park et al.
2008/0226367 A1 9/2008 Kim et al.
2009/0087214 A1 4/2009 Utsunomiya et al.
2009/0214254 A1 8/2009 Jeon
2009/0222664 A1 9/2009 Cho et al.

FOREIGN PATENT DOCUMENTS

JP 9106162 4/1997
JP 10301460 11/1998
JP 11002947 1/1999
JP 2002341648 11/2002
KR 1020040110339 12/2004
KR 1020060081453 7/2006
KR 1020070097994 10/2007

OTHER PUBLICATIONS

Extended European Search Report issued Aug. 4, 2011 in EP Application No. 10175192.3.
Korean Office Action issued Aug. 26, 2011 in KR Application No. 10-2010-0070473.
Extended European Search Report issued May 24, 2011 in EP Application No. 10175135.2.
Partial European Search Report issued May 20, 2011 in EP Application No. 10175192.3.
Korean Notice of Allowance Issued on Sep. 27, 2012 in KR Patent Application No. 10-2011-0109436.

* cited by examiner

*Primary Examiner* — Hoang Ngo
(74) *Attorney, Agent, or Firm* — Stanzione & Kim, LLP

(57) ABSTRACT

A developer of an image-forming apparatus includes a photoconductor, a housing comprising a waste toner container in which waste toner removed from the photoconductor is contained, and a recessed portion depressed downwardly in a center portion of an upper wall of the waste toner container, the center portion corresponding to a center portion of the photoconductor in a lengthwise direction to move toner away from the center portion.

34 Claims, 25 Drawing Sheets

DEVELOPER AND IMAGE FORMING APPARATUS INCLUDING THE SAME

CROSS-REFERENCE TO RELATED APPLICATIONS

This application claims the benefit of Korean Patent Application No. 10-2010-0070473, filed on Jul. 21, 2010, Korean Patent Application No. 10-2010-0005758, filed on Jan. 21, 2010, and Korean Patent Application No. 10-2010-0006500, field on Jan. 25, 2010, in the Korean Intellectual Property Office, the disclosures of which are incorporated herein in their entirety by reference.

BACKGROUND

1. Field of the Invention

The present general inventive concept relates to a developer which may be attached to and detached from an image forming apparatus and an image forming apparatus including the developer.

2. Description of the Related Art

An electrophotographic image forming apparatus prints images on a recording medium through several processes, which may include irradiating light modulated according to image information onto a photoconductor to form an electrostatic latent image on the surface of the photoconductor, supplying toner to the electrostatic latent image to develop the electrostatic latent image into a visible toner image, and transferring and fixing the toner image onto the recording medium. The electrophotographic image forming apparatus includes a developing device which contains toner.

The photoconductor and the toner may be provided in the form of a replaceable cartridge that is commonly referred to as a 'developer'. When the toner in the developer is exhausted, the developer may be removed from the electrophotographic image forming apparatus and replaced with a new developer.

SUMMARY

The present general inventive concept provides a developer having an improved structure including a container for storing waste toner removed from a photoconductor after developing and an image forming apparatus including the developer.

The present general inventive concept also provides a developer which may prevent toner included therein from being leaked before the developer is installed to an image forming apparatus and an image forming apparatus including the developer.

The present general inventive concept also provides a developer having improved security which may be attached to and detached from an image forming apparatus and an image forming apparatus including the developer.

Additional aspects and utilities of the present general inventive concept will be set forth in part in the description which follows and, in part, will be obvious from the description, or may be learned by practice of the present general inventive concept.

Features and/or utilities of the present general inventive concept may be achieved by a developer attached to and detached from a main body of an image forming apparatus, the developer including a photoconductor, and a housing including a waste toner container to receive waste toner from the photoconductor. The housing may include an upper wall having a recessed portion depressed downwardly in a center portion of the upper wall of the waste toner container, the center portion corresponding to a center portion of the photoconductor in a lengthwise direction.

A gap between side walls of the recessed portion may gradually decrease in a downward direction.

The waste toner container may include a cleaning unit in which a cleaning member is installed, and a container spaced apart from the cleaning unit to contain the waste toner transferred from the cleaning unit by a waste toner transporting member. A gap between both side walls of the recessed portion may gradually increase from the cleaning unit toward the container.

The waste toner transporting member may move back and forth and upward and downward.

The developer may further include a rotation member installed in the container and including an eccentricity unit, wherein the housing may include a support unit of which at least a part thereof is inclined upward toward the container from the cleaning unit. The waste toner transporting member may include a support protrusion that contacts the support unit by sliding. An end part of the waste toner transporting member may be combined with the eccentricity unit to move back and forth and upward and downward due to a rotation of the rotation member.

The waste toner transporting member may include a plurality of horizontal ribs that are spaced apart from each other in a direction of the back-and-forth movement, and a plurality of spaces to transport the waste toner may be formed between the plurality of horizontal ribs.

Widths of the spaces may gradually decrease in a direction from the cleaning unit toward the container.

The developer may further include a customer replaceable unit monitor (CRUM) unit including a central processing unit (CPU) which performs at least one of authentication and encrypted data communication with the main body of the image forming apparatus by using its own operating system (O/S).

The housing may include a toner container, a developing portion in which a developing roller to supply toner to the photoconductor is installed, and a toner supply window connecting the toner container to the developing portion. The developer may include a pair of rails located on the toner supply window to extend in a lengthwise direction of the developing roller and a blocking member including a blocking portion which opens/closes the toner supply window by being inserted into or removed from the pair of rails from the outside of the housing via an insertion hole prepared on an outer sidewall of the housing to be aligned with the rails.

The blocking member may include a bent portion extended from the blocking portion and disposed at the outside of the housing while the blocking portion is inserted in the rails.

The developer may further include a customer replaceable unit monitor (CRUM) unit including a central processing unit (CPU) which performs at least one of authentication and encrypted data communication with the main body of the image forming apparatus by using its own operating system (O/S). The CRUM unit may be exposed to the outside via the outer sidewalls of the housing to electrically connect to the main body of the image forming apparatus and the bent portion covers the CRUM unit while the blocking portion is inserted in the rails. The bent portion may be bent parallel to the outer sidewalls of the housing. The bent portion may be divided from the blocking portion by a bending line and may be bent parallel to the outer sidewalls of the housing along the bending line. The developer may further include a securing portion disposed on the outer sidewalls of the housing to secure the bent portion while the blocking portion covers the CRUM unit. A toner leakage prevention member which is an elastic member and covers the insertion hole may be attached to the outer sidewalls of the housing.

Features and/or utilities of the present general inventive concept may also be realized by an electrophotographic image forming apparatus including a main body; and the developer attached to and detached from the main body.

Features and/or utilities of the present general inventive concept may include a developer unit including a photoconductor to form an image thereon, a housing including a waste toner container to receive waste toner from the photoconductor, and a support member to transmit the waste toner from the photoconductor to the waste toner container. The housing may include an upper wall to cover at least portions of the photoconductor, the support member, and the waste toner container, and the upper wall may include a substantially planar surface and a recessed portion recessed inward from the plane of the substantially planar surface to be closer to the support member than the substantially planar surface, the recessed portion located at a center of the upper wall in a lengthwise direction, the lengthwise direction corresponding to an end-to-end length of the photoconductor.

A length of a gap separating side walls of the recessed portion in the lengthwise direction may decrease in a downward direction toward the support member.

The side walls of the recessed portion may have one of a convex and a concave shape in a downward direction.

A length of a gap separating side walls of the recessed portion in the lengthwise direction may increase in a front-to-back direction from the photoconductor towards the waste toner container.

The side walls of the recessed portion may have one of a convex and a concave shape in the lengthwise direction.

The bottom surface of the recessed portion may have one of a convex and a concave shape in a downward direction.

Features and/or utilities of the present general inventive concept may include a photoconductor to form an image thereon, a toner storage portion to supply toner to the photoconductor, and a toner waste removal portion to remove waste toner from the photoconductor. The toner storage portion may be spaced apart from the toner waste removal portion, and light to form the image on the photoconductor may be transmitted between the toner storage portion and the toner waste removal portion to the photoconductor.

Features and/or utilities of the present general inventive concept may also be realized by a developer unit including a photoconductor to form an image thereon, a toner storage portion to supply toner to the photoconductor, the toner storage portion including a toner container to store the toner and a supply roller to supply the toner from the toner storage container to the photoconductor. The supply roller may be mounted to a side wall of the developer unit via a shaft, the side wall having a first side facing the supply roller and a second side opposite the first side, a blocking member may be attached to the shaft on the second side of the side wall, and a sealing member may be located on the second side of the side wall to fix the blocking member to the second side of the side wall.

The second side of the side wall may include a recess corresponding to a size of the blocking member, and the sealing member may fill the recess.

The blocking member may be only a single washer.

Features and/or utilities of the present general inventive concept may also be realized by an image-forming apparatus including an exposing unit to emit a light, and a developer unit to receive the light from the exposing unit and to apply a toner to a recording medium according to the received light.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE EMBODIMENTS

Figure 1:
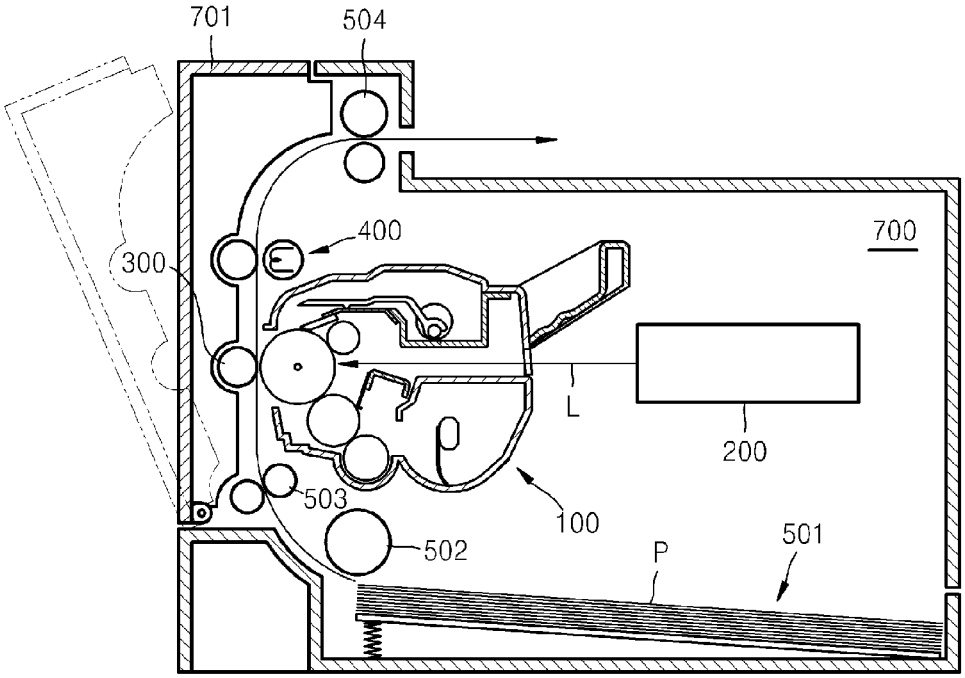
FIG. 1 is a diagram of an image forming apparatus according to an embodiment of the present general inventive concept.

Hereinafter, a developer and an image forming apparatus of the present general inventive concept will be described more fully with reference to the accompanying drawings, in which exemplary embodiments of the present general inventive concept are shown. Like reference numerals refer to the like elements throughout.

Figure 2:
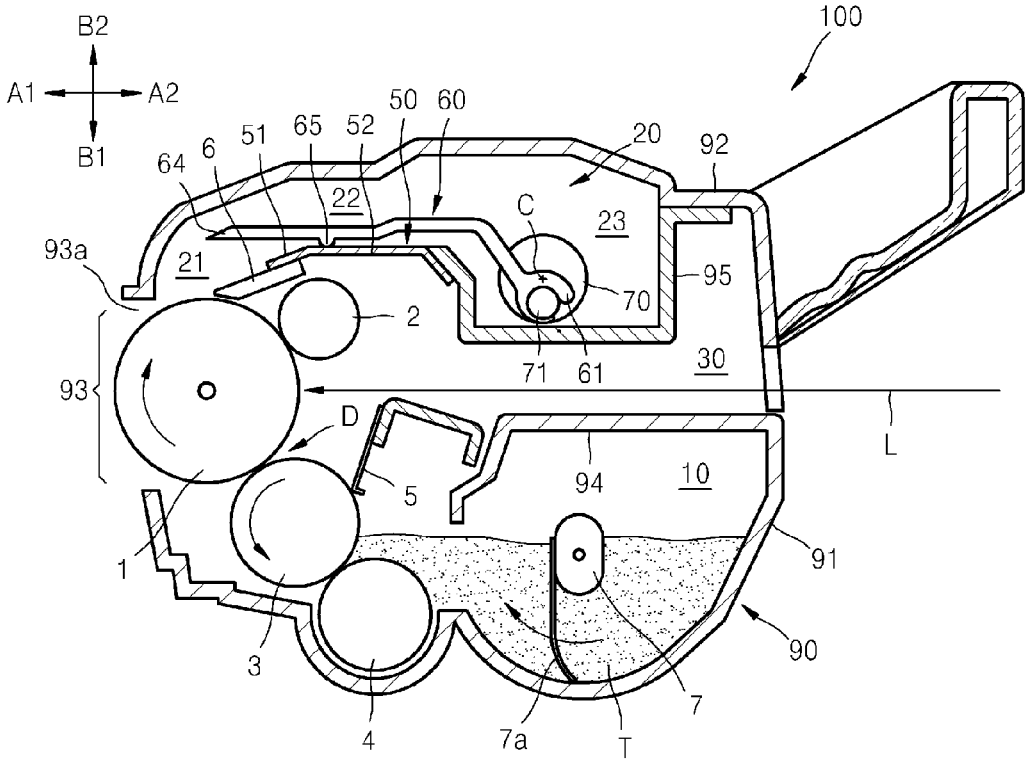
FIG. 2 is a diagram of a developer according to an embodiment of the present general inventive concept.

FIG. 1 is a diagram of an image forming apparatus according to an embodiment of the present general inventive concept and FIG. 2 is a diagram of a developer 100 included in the image forming apparatus of FIG. 1 according to an embodiment of the present general inventive concept. The developer 100 according to the current embodiment is an integration-type developer including a photoconductive drum 1 and a developing roller 3.

Referring to FIG. 2, the photoconductive drum 1, an example of a photoconductor on which an electrostatic latent image is formed, includes a cylindrical metal pipe and a photoconductive layer formed on the circumference of the cylindrical metal pipe. A charging roller 2 is an example of a charger which charges the surface of the photoconductive drum 1 with a uniform electric potential. A charging bias voltage is applied to the charging roller 2. A corona charger (not illustrated) may be used instead of the charging roller 2. The developing roller 3 applies toner T to the electrostatic latent image formed on the surface of the photoconductive drum 1 and develops the electrostatic image into a toner image. In the current embodiment, a contact development method is used, wherein the developing roller 3 and the photoconductive drum 1 contact each other to form a development nip D. In this case, the developing roller 3 may include an elastic layer (not illustrated) formed on the circumference of a conductive metal core (not illustrated). When a developing bias voltage is applied to the developing roller 3, toner T is transferred and attached to the electrostatic latent image formed on the surface of the photoconductive drum 1 through the development nip D. In this case, the developing roller 3 may include an elastic layer (not illustrated) formed on the circumference of a conductive metal core (not illustrated). When a developing bias voltage is applied to the developing roller 3, toner T is transferred and attached to the electrostatic latent image formed on the surface of the photoconductive drum 1 through the development nip D. If a non-contact development method is used, the surface of the developing roller 3 and the surface of the photoconductive drum 1 are spaced apart from each other by an interval of about few hundreds microns.

The developer 100 may further include a supply roller 4 for attaching toner T to the developing roller 3. A supply bias voltage may be applied to the supply roller 4 in order to attach toner T to the developing roller 3. A regulator 5 regulates an amount of toner T attached to the developing roller 3. The regulator 5 may be, for example, a regulator blade having a front end that contacts the developing roller 3 with a predetermined pressure. A cleaning member 6 removes the remaining toner T and foreign bodies from the surface of the photoconductive drum 1 before charging. The cleaning member 6 may be, for example, a cleaning blade of which front end contacts the surface of the photoconductive drum 1. Hereinafter, the foreign bodies removed from the surface of the photoconductive drum 1 are referred to waste toner.

The developer 100 may include a toner container 10 and a waste toner container 20. The waste toner container 20 stores waste toner removed from the surface of the photoconductive drum 1. The developer 100 illustrated in FIG. 2 uses a one-component developing agent, toner T. The toner T is stored in the toner container 10. The toner container 10 includes an agitator 7 that transfers toner T to the developing roller 3. The agitator 7 may agitate toner T and charge the toner T with a predetermined electric potential. In FIG. 1, one agitator 7 is illustrated, however, the present general inventive concept is not limited thereto. An appropriate number of agitators 7 may be installed in an appropriate position of the toner container 10 in order to efficiently supply toner T to the developing roller 3 in consideration of the capacity and shape of the toner container 10. The agitator 7 may include one or more agitating blades 7*a* in the form of a flexible film on a rotation shaft. The agitator 7 may be an auger having a spiral blade.

When a two-component developing agent including a toner T and carrier is used, the toner container 10 stores magnetic carrier and toner T. In this case, the developing roller 3 may include a magnet in a rotating sleeve. Due to the magnetic force of the magnet, the carrier is attached to the circumference of the developing roller 3 and the toner T is attached to the carrier by an electrostatic force so that a magnetic brush formed of carrier and toner T is formed on the circumference of the developing roller 3. Due to the developing bias voltage applied to the developing roller 3, only toner T is transferred to the electrostatic latent image formed on the photoconductive drum 1. The regulator 5 is spaced apart from the surface of the developing roller 3 by a predetermined distance and regulates a height of the magnetic brush formed on the circumference of the developing roller 3. The agitator 7 transfers the carrier and toner T to the developing roller 3. The agitator 7 may also agitate the carrier and toner T, thereby friction-charging the toner T.

A housing 90 of the developer 100 may include a lower frame 91 and an upper frame 92. A part of the photoconductive drum 1 is exposed to the outside of the housing 90 through openings 93. First and second inside frames 94 and 95 may be included in the housing 90. The lower frame 91 and the first inside frame 94 constitute the toner container 10, and the upper frame 92 and the second inside frame 95 constitute the waste toner container 20. The first inside frame 94 and the second inside frame 95 are spaced apart from each other and an optical path 30, along which light L scanned from an exposing unit 200 of FIG. 2 to expose the photoconductive drum 1 travels, is formed between the first inside frame 94 and the second inside frame 95.

Referring to FIG. 1, the developer 100 is installed in a main body 700 of the image forming apparatus through a door 701. The exposing unit 200 scans light L modulated according to image information onto the surface of the photoconductive drum 1 charged by a uniform electric potential. For example, a laser scanning unit (LSU) may be used as the exposing unit 200. The LSU deflects light irradiated from a laser diode to a main scanning direction by using a polygon mirror and scans the deflected light onto the photoconductive drum 1.

A transfer roller 300 is a transfer unit located to face the surface of the photoconductive drum 1 and forms a transfer nip. A transfer bias voltage for transferring a toner image developed on the surface of the photoconductive drum 1 to a recording medium P is applied to the transfer roller 300. A corona transfer unit may be used instead of the transfer roller 300.

The toner image transferred onto the surface of the recording medium P by the transfer roller 300 remains on the surface of the recording medium P due to electrostatic attraction. A fixing unit or fusing unit 400 fixes the toner image to the recording medium P by applying heat and pressure to the toner image and a permanent printed image is formed on the recording medium P.

A process of forming an image when the apparatus of FIG. 1 is used is briefly described below. A charging bias voltage is applied to the charging roller 2 and the photoconductive drum 1 is charged with a uniform electric potential. The exposing unit 200 scans light modulated in correspondence to image information onto the photoconductive drum 1 through the optical path 30 in the developer 100 and forms an electrostatic latent image on the surface of the photoconductive drum 1. Toner T is transferred toward the supply roller 4 by the agitator 7 and the supply roller 4 attaches the toner T to the surface of the developing roller 3. The regulator 5 forms a toner layer having a uniform thickness on the surface of the developing roller 3. A developing bias voltage is applied to the developing roller 3. As the developing roller 3 rotates, the toner T transferred to the development nip D is transferred and attached to the electrostatic latent image formed on the surface of the photoconductive drum 1 by a developing bias voltage so that a visible toner image is formed on the surface of the photoconductive drum 1. The recording medium P withdrawn from a recording medium tray 501 by a pickup roller 502 is transferred by a feeding roller 503 to a transfer nip that faces the transfer roller 300 and the photoconductive drum 1. When a transfer bias voltage is applied to the transfer roller 300, the toner image is transferred to the recording medium P due to electrostatic attraction. Then, the toner image transferred to the recording medium P is fixed onto the recording medium P by the fixing unit 400 that applies heat and pressure to the toner image and thus printing is completed. The recording medium P is discharged by a discharge roller 504. Toner T that is not transferred to the recording medium P and remains on the photoconductive drum 1 is removed by the cleaning member 6 and is stored in the waste toner container 20.

Referring to FIG. 2, the waste toner container 20 may include a cleaning unit or area 21, a waste toner storage area 23, and a connecting unit or area 22. In the cleaning unit 21, the photoconductive drum 1 and the cleaning member 6 contact each other to remove the waste toner. The storage area 23 is spaced apart from the cleaning area 21, and the connecting area 22 connects the cleaning area 21 and the storage area 23. The waste toner removed from the surface of the photoconductive drum 1 is piled up on the cleaning area 21 until it fully fills the cleaning area 21 and is gradually transferred to the connecting area 22 and the storage area 23. After printing of an image is completed, an internal temperature of the image forming apparatus gradually decreases by residual heat of the fixing unit 400. Thus, the waste toner in the waste toner container 20, in particular, the cleaning area 21, may be hardened by residual heat of the fixing unit 400 and be transformed into a lump state. Also, the lump-form waste toner is attached to the front end of the cleaning member 6 and interrupts a transfer of the waste toner to the waste toner container 20 so that the waste toner may leak to the outside through a gap 93*a* between the photoconductive drum 1 and the housing 90.

The developer 100 according to the current embodiment includes a waste toner transporting member 60 installed in the waste toner container 20 to transfer the waste toner to the storage area 23 from the cleaning area 21. The waste toner transporting member 60 according to the current embodiment moves back and forth in the waste toner container 20 in directions A1 and A2. In addition, a front end part 64 of the waste toner transporting member 60 moves perpendicularly (directions B1 and B2) to the back-and-forth movement in the cleaning area 21, that is, upward and downward. Due to a combination of the back-and-forth movement of the waste toner transporting member 60 and the upward-and-downward movement of the front end part 64, the lump waste toner in the cleaning area 21 is crushed. Due to the back-and-forth movement of the waste toner transporting member 60, the waste toner is moved to the storage area 23 from the cleaning area 21.

Figure 3:
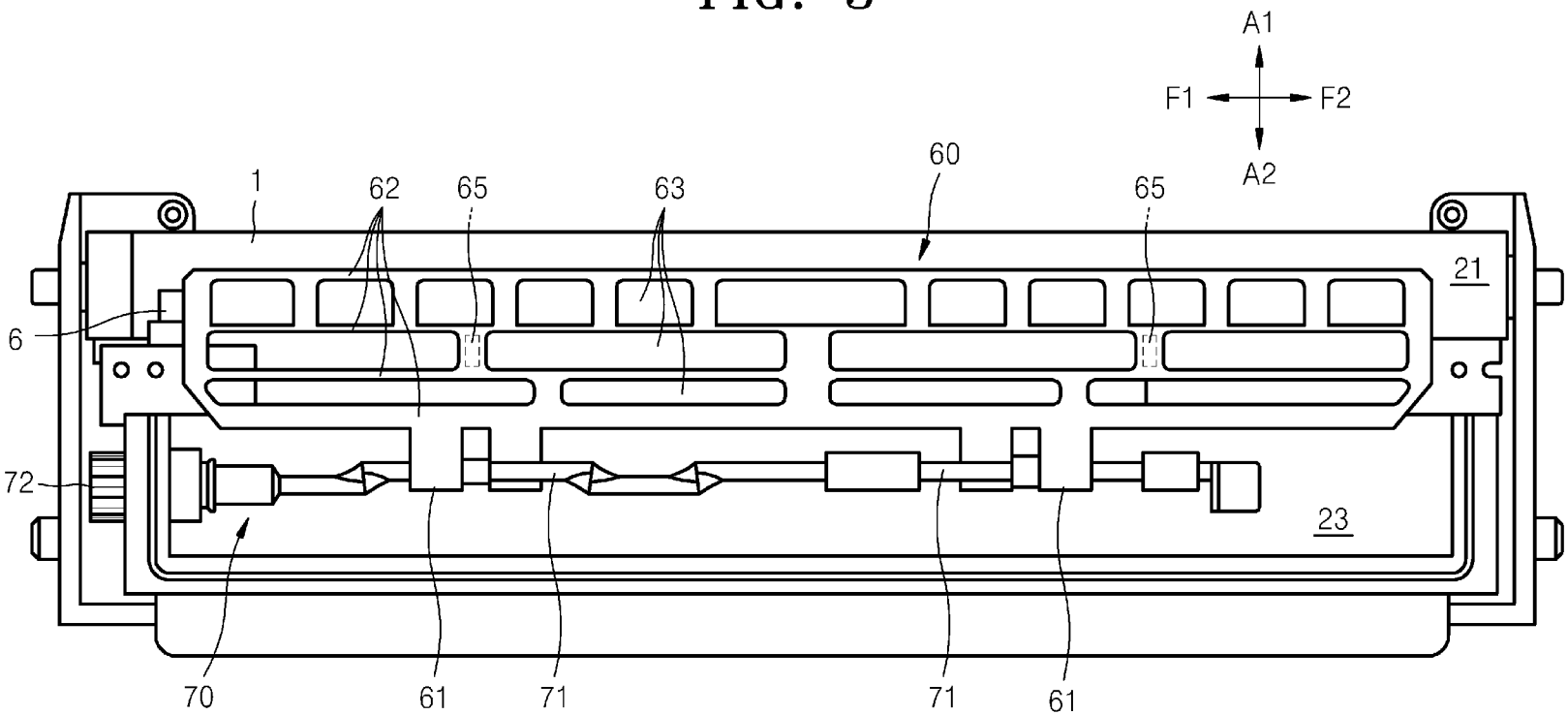
FIG. 3 is a plan view of the developer of FIG. 2 from which an upper frame is removed, according to an embodiment of the present general inventive concept.

FIG. 3 is a plan view of the developer 100 of FIG. 2 from which the upper frame 92 is removed, according to an embodiment of the present general inventive concept. Referring to FIGS. 2 and 3, a rotation member 70 including an eccentricity unit 71 that is eccentric or offset with respect to the rotation center C of the rotation member 70 is installed in the developer 100. The rotation member 70 may be located in the waste toner storage area 23. A gear 72 is installed at one end of the rotation member 70. When the developer 100 is installed in the image forming apparatus, the gear 72 is connected to a driving unit (not illustrated) included in the image forming apparatus and is rotated.

The waste toner transporting member 60 extends toward the cleaning area 21 from the storage area 23. The one end of the waste toner transporting member 60, that is, an end 61 located in the storage area 23, is connected to the eccentricity unit 71 so as to be rotated. The waste toner transporting member 60 may include a plurality of horizontal ribs 62 that are spaced apart from each other in the back-and-forth movement directions A1 and A2 and which extend along the horizontal axis F. As the waste toner is inserted into spaces 63 interposed between the plurality of horizontal ribs 62 when the waste toner transporting member 60 moves back and forth, the waste toner is moved to the storage area 23 from the cleaning area 21 through the connecting area 22.

The connecting area 22 includes a support unit 50 that supports the waste toner transporting member 60. The support unit 50 contacts the waste toner transporting member 60 and guides the waste toner transporting member 60 to be moved back and forth and upward and downward. The support unit 50 may be disposed below the waste toner transporting member 60. The waste toner transporting member 60 may include a support protrusion 65 that contacts the support unit 50 by sliding. One or more support protrusion 65 may be arranged in a transverse direction, or along the horizontal axis F. The support unit 50 may include an inclined portion 51 and an extended portion 52. The inclined portion 51 is inclined upward from the cleaning area 21 toward the container 23. The extended portion 52 extends toward the waste toner storage area 23 from the inclined portion 51 and has an inclination angle that is gentler than that of the inclined portion 51. The support unit 50 may be a bracket to fix or attach the cleaning member 6 to the housing 90. That is, the cleaning member 6 is installed at the bracket and the bracket may be installed at the housing 90, for example, the second inside frame 95. According to the above structure, the form of the support unit 50 may be changed just by correcting a bracket and thus a motion of the waste toner transporting member 60 may be changed so as to efficiently transfer waste toner.

Figure 4:
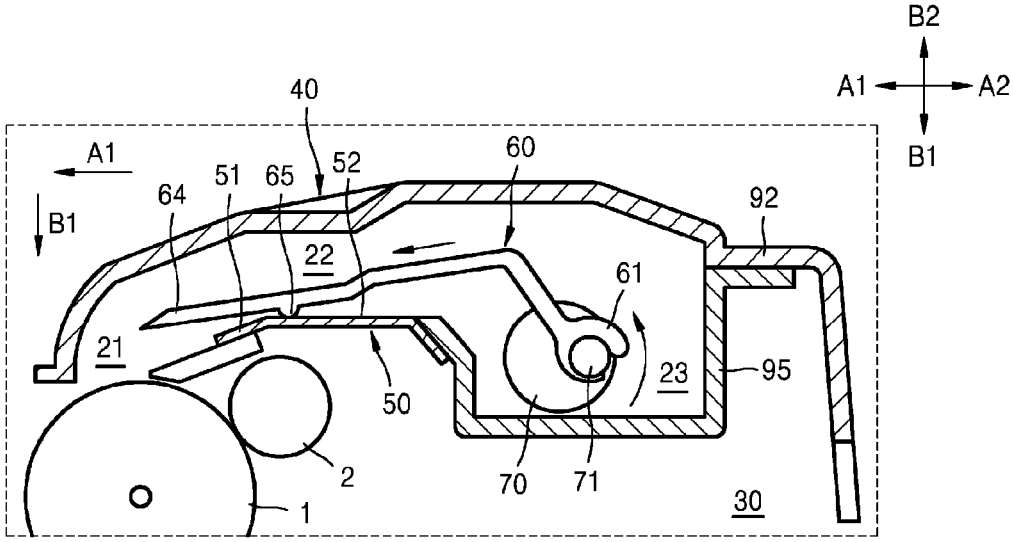
FIGS. 4 through 7 are diagrams to illustrate operation of a waste toner transporting member.

FIGS. 4 through 7 are diagrams to explain operation of the waste toner transporting member 60. Referring to FIG. 4, the waste toner transporting member 60 is located in a retreated position toward the rear wall of the waste toner storage area 23 in the direction A2. The eccentricity unit 71 of the rotation member 70 is located at a right dead point of the eccentricity unit 71, or an extreme rotation point of the eccentricity unit 71 in the direction A2. The support protrusion 65 of the waste toner transporting member 60 is supported by the extended portion 52 of the support unit 50. When the rotation member 70 is rotated in a counter-clockwise direction, the waste toner transporting member 60 is supported by the extended portion 52 and moves forward to the cleaning unit 21 in the direction A1. Also, as the eccentricity unit 71 moves toward a top dead point, or an apex in the direction G2, the location of the end 61 gradually moves upward in the direction B2. Thus, the waste toner transporting member 60 rotates with the support protrusion 65 as a support point so that the front end part 64 of the waste toner transporting member 60 rotates downward, that is, the direction B1. Accordingly, the front end part 64 of the waste toner transporting member 60 moves forward in the direction A1 and gradually drops in the direction B1.

Figure 5:
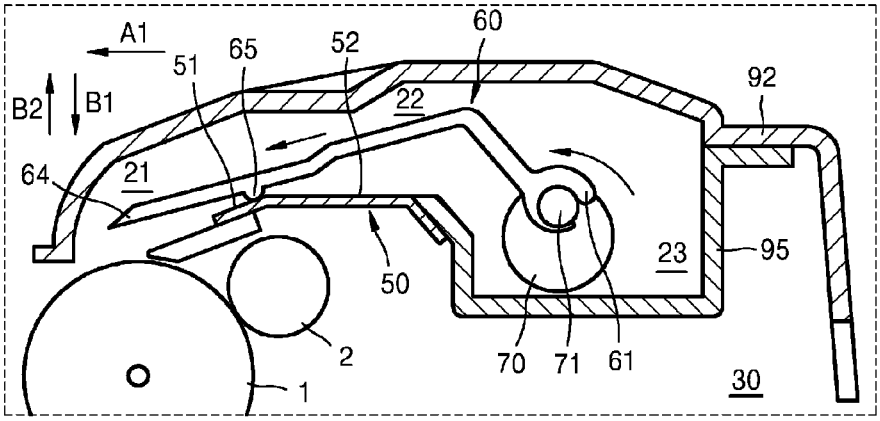

As illustrated in FIG. 5, when the eccentricity unit 71 of the rotation member 70 passes the top dead point, the support protrusion 65 is supported by the inclined portion 51. Then, the waste toner transporting member 60 is guided by the inclined portion 51 and moves downward toward the cleaning area 21. Due to the forward movement in the direction A1 and the downward movement in the direction B1, the front end part 64 of the waste toner transporting member 60 penetrates the waste toner contained in the cleaning area 21 and crushes the lump waste toner so that the waste toner is filled in the spaces 63 interposed between the plurality of ribs 62.

As the rotation member 70 is rotated and the eccentricity unit 71 of the rotation member 70 moves toward a left dead point, or to an extreme point in the direction A1, the location of the end 61 is gradually changed in a downward direction. Thus, the waste toner transporting member 60 rotates with the support protrusion 65 as a support point so that the front end part 64 of the waste toner transporting member 60 rotates upward, that is, the direction B2.

Figure 6:
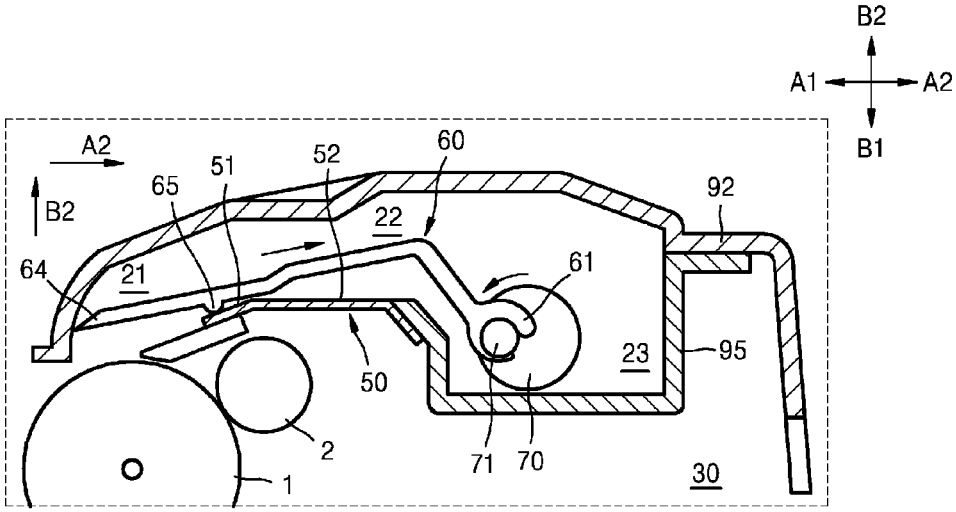

As illustrated in FIG. 6, after the eccentricity unit 71 of the rotation member 70 reaches the left dead point, the waste toner transporting member 60 changes its moving direction and moves in the direction A2, that is, toward the rear of the waste toner storage area 23. The front end 64 part of the waste toner transporting member 60 is moved upward in the direction B2.

Figure 7:
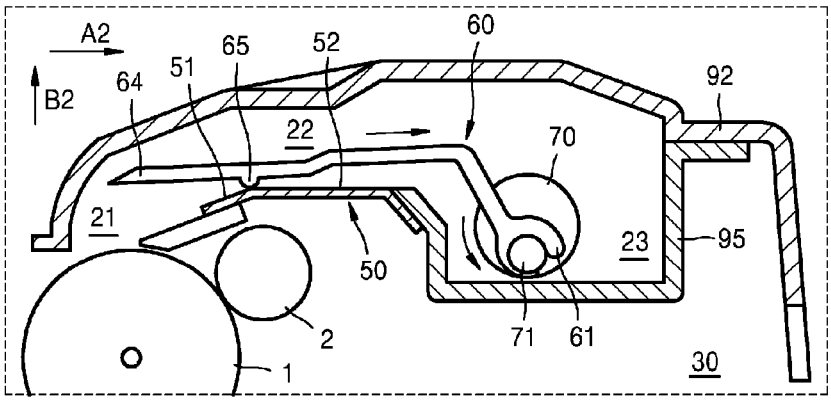

As illustrated in FIG. 7, when the eccentricity unit 71 of the rotation member 70 passes a lower dead point, or a nadir in the direction B1, the support protrusion 65 is supported by the extended portion 52 again. When the eccentricity unit 71 moves toward the right dead point, or an extreme point in the direction A2, as illustrated in FIG. 4, due to the rotation of the rotation member 70, the waste toner is inserted into the spaces 63 interposed between the plurality of horizontal ribs 62 and is transferred to the waste toner container 20.

As described above, while the waste toner transporting member 60 moves back and forth in the directions A1 and A2, the front end part 64 of the waste toner transporting member 60 moves upward and downward in the directions B1 and B2 in the cleaning area 21. Due to a combination of the back-and-forth movement and the upward-and-downward movement, the lump waste toner in the cleaning area 21 is crushed and easily moved to the waste toner container 20. Also, as the support protrusion 65 contacts the support unit 50 by a sliding motion, the back-and-forth movement and upward-and-downward movement of the waste toner transporting member 60 are guided and thus the waste toner transporting member 60 may be easily assembled.

Figure 8:
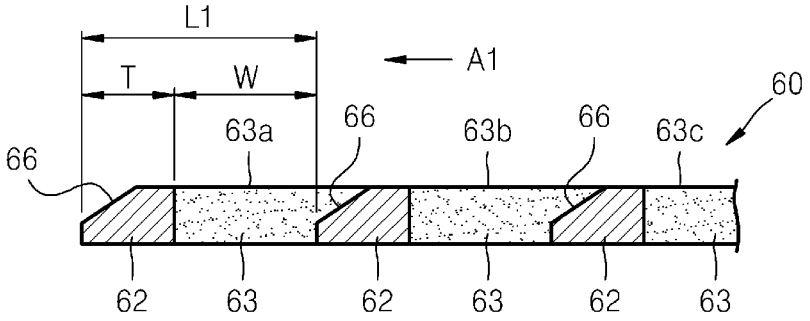
FIG. 8 is a cross-sectional diagram of a front end part of a waste toner transporting member.

Referring to FIG. 8, as the waste toner transporting member 60 moves back and forth, the waste toner moves to the waste toner storage area 23 sequentially through a space 63*a*, a space 63*b*, and a space 63*c*. Chamfered portions 66 may be prepared on the edges of the plurality of ribs 62 toward the cleaning area 21. Accordingly, when the waste toner transporting member 60 moves to the cleaning area 21, that is, in the direction A1, the waste toner may easily pass the chamfered portions 66 and may be easily inserted into the spaces 63*a*, 63*b*, and 63*c* interposed between the plurality of ribs 62. If the plurality of ribs 62 have the same the thickness T and the spaces 63*a*, 63*b*, and 63*c* have the same widths W, a stroke length of the waste toner transporting member 60 may be set to be larger than T+W.

When the waste toner remains in the spaces 63*a*, 63*b*, and 63*c*, the waste toner that is left in the spaces 63*b* and 63*c* may harden when the image forming apparatus does not operate. Accordingly, after an image forming process is completed and the back-and-forth movement of the waste toner transporting member 60 is completed, it is preferable that the waste toner should not remain in the spaces 63*a*, 63*b*, and 63*c*. If the widths W of the spaces 63*b* and 63*c* are larger than that of the space 63*a* and the stroke length of the waste toner transporting member 60 is not long enough for the space 63*a* to cover the space 63*b* or for the space 63*b* to cover the space 63*c* with the stroke length, the waste toner that is not transferred remains always in the spaces 63*b* and 63*c*. To prevent such an occurrence, the widths of the spaces 63*a*, 63*b*, and 63*c* may sequentially decrease. In other words, the length of the space 63*a* may be greater than that of the space 63*b*, and the width of the space 63*b* may be greater than that of the space 63*c*. A stroke length of the waste toner transporting member 60 may be set to be larger than the sum of the width of the space 63*a* and the thickness T of the horizontal rib 62. Accordingly, the waste toner may be accurately and sequentially moved to the storage area 23 through the spaces 63*a*, 63*b*, and 63*c* due to the back-and-forth movement of the waste toner transporting member 60. In order to set the widths of the spaces 63*a*, 63*b*, and 63*c* to decrease sequentially, the thickness T of each of the horizontal ribs 62 may be set to gradually increase from the cleaning area 21 to the storage area 23, in the direction A2, if intervals L1 between the plurality of horizontal ribs 62 are the same as each other. A stroke length of the waste toner transporting member 60 may be set to be larger than intervals L1.

As the center portion of the photoconductive drum 1 in the side-to-side lengthwise axis F is primarily used in forming an image as compared to the end portions, waste toner may be mainly generated in the center portion. The waste toner removed from the photoconductive drum 1 is piled up on the cleaning area 21, and an amount of waste toner collected in the center portion of the cleaning area 21 increases. Then, as pressure of the waste toner in the center portion of the cleaning unit 21 increases compared with end portions of the cleaning area 21, toner T may leak through the gap 93*a* of FIG. 2 between the photoconductive drum 1 and the housing 90.

Figure 9:
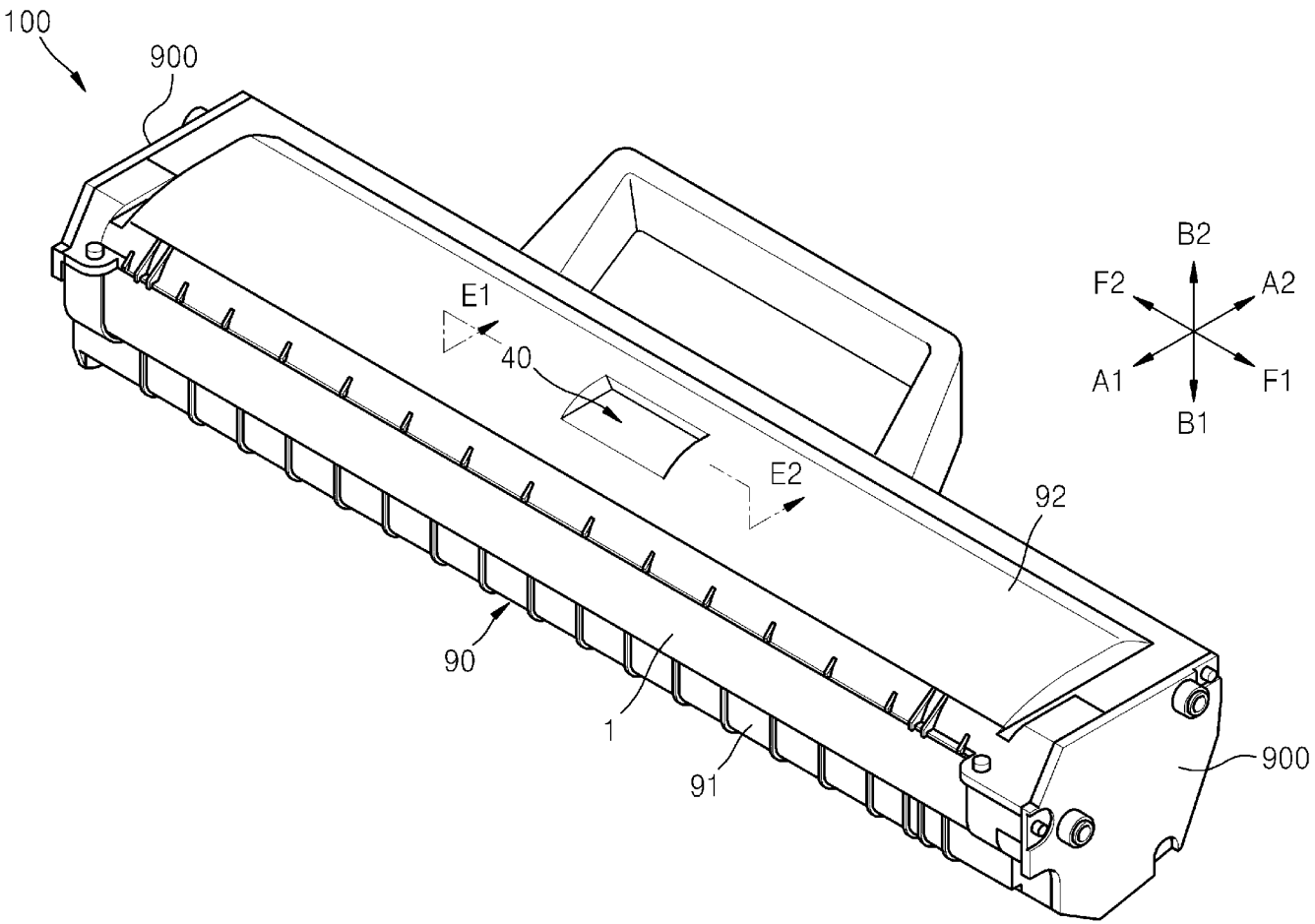
FIG. 9 is a perspective view of the developer of FIG. 2 including a recessed portion.
Figure 10A:
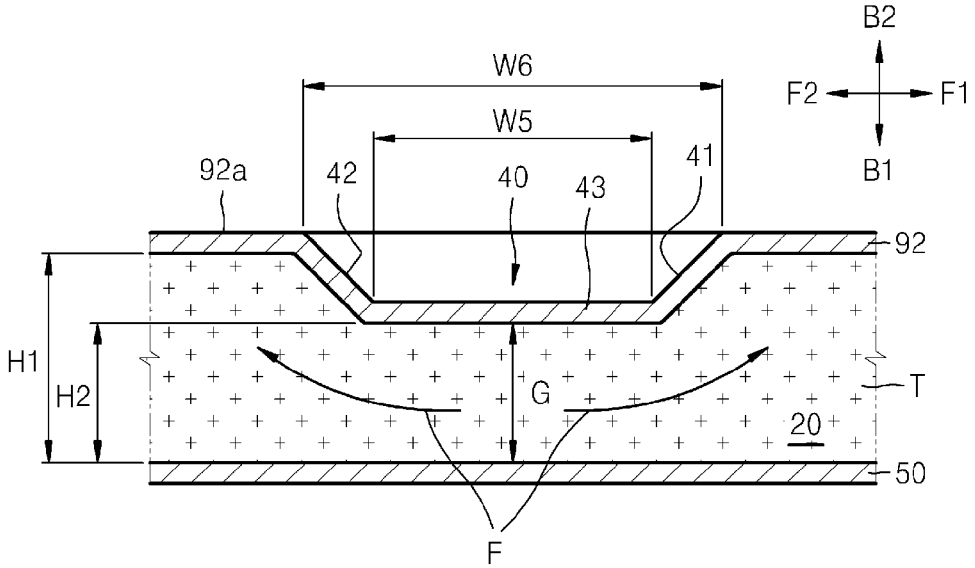
FIG. 10A is a cross-sectional diagram of the developer of FIG. 9 cut along the line E1-E2 of FIG. 9.

FIG. 9 is a perspective view of the developer 100 according to an embodiment of the present general inventive concept and FIG. 10A is a cross-sectional diagram of the developer 100 of FIG. 9 cut along the line E1-E2 of FIG. 9. Referring to FIGS. 2, 9, and 10A, the upper frame 92 constitutes an upper wall of the waste toner container 20. A recessed portion 40 depressed downwardly is formed in the center portion of the upper frame 92. The recessed portion 40 may be formed in an area corresponding to the cleaning unit 21 of the upper frame 92, an area corresponding to the connecting area 22, or an area throughout the cleaning area 21 and the connecting area 22. The waste toner removed from the surface of the photoconductive drum 1 by the cleaning member 6 fills the cleaning area 21 and then the photoconductive drum 1 is rotated so that the waste toner gradually moves to the waste toner storage area 23 due to the back-and-forth movement of the waste toner transporting member 60.

As illustrated in FIG. 10A, an interval G between the portion of the waste toner container 20 where the recessed portion 40 is formed and the support unit 50 is narrower than intervals between the both portions of the waste toner container 20 where the recessed portion 40 is not formed and the support unit 50. In other words, the height H2 between a bottom 43 of the recessed portion 40 and the support member 50 is less than a height H1 between a substantially planar upper surface 92*a* of the upper frame 92 and the support member 50. Accordingly, as illustrated by the arrow F, the waste toner is pushed out to either side of the recessed portion 40 and is dispersed to the edge of the waste toner container 20. Thus, pressure of the waste toner may be prevented from increasing in the center portions of the waste toner container 20 and the photoconductive drum 1.

As illustrated in FIG. 10A, walls 41 and 42 of the recessed portion 40 may be inclined so that the waste toner can be easily dispersed. That is, the recessed portion 40 may be formed so that the space between the walls 41 and 42 decreases in a downward direction B1. In particular, the width W5 of the bottom surface 43 of the recessed portion 40 is less than a width W6 of a top of the recessed portion 40.

Figure 10B:
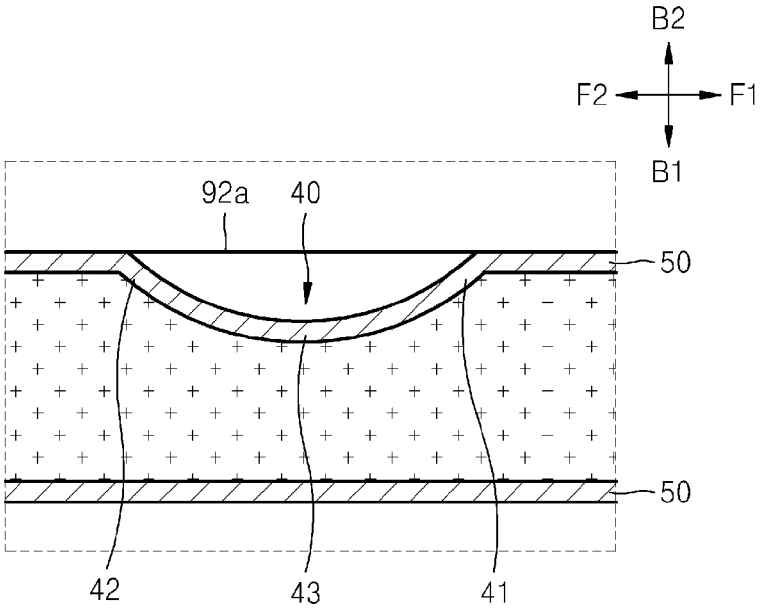
FIGS. 10B and 10C illustrate cross-sectional diagrams of the developer of FIG. 9 cut along the line E1-E2 according to additional embodiments of the present general inventive concept.
Figure 10C:
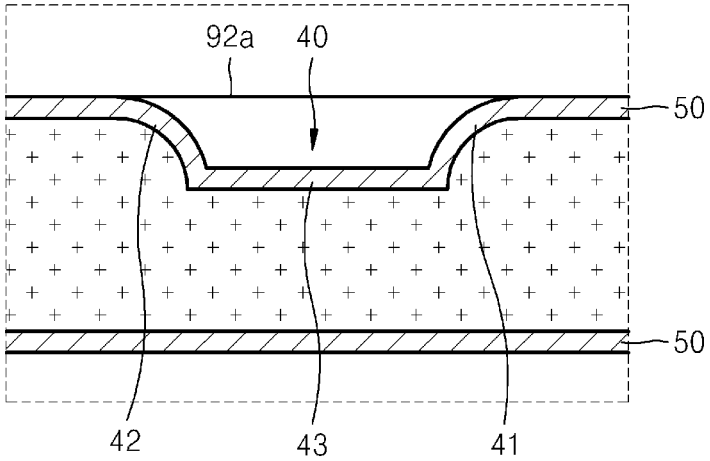

As illustrated in FIGS. 10B and 10C, the side walls 41 and 42 and the bottom surface 43 of the recessed portion 40 may have a convex shape, as illustrated in FIG. 10B or a concave shape, as illustrated in FIG. 10C. However, the surfaces may have any appropriate shape, including combinations of convex and concave shapes within a same recessed portion 40.

Figure 11A:
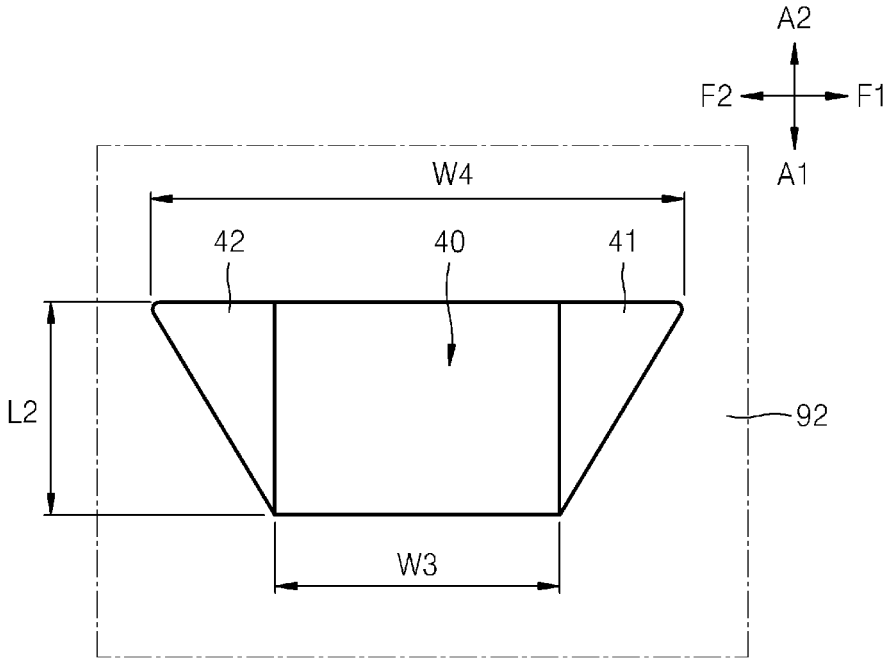
FIG. 11A is a plan view of the recessed portion of FIG. 9.

Also, as illustrated in FIG. 11A, a distance between the walls 41 and 42 of the recessed portion 40 may increase in the direction A2 from the cleaning unit 21 to the connecting area 22. That is, the width W3 at the side closest to the cleaning area 21 may be smaller than the width W4 at the side of the recessed portion 40 closest to the connecting area 22.

Figure 11B:
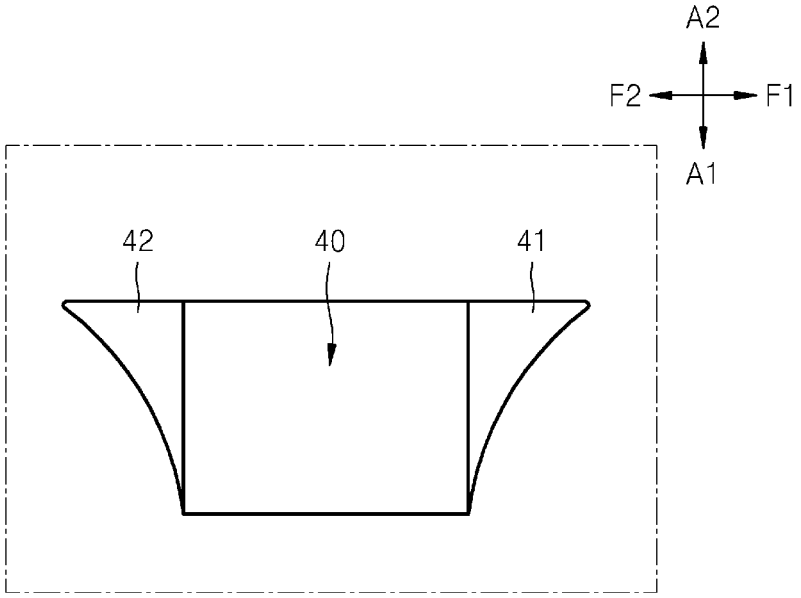
FIGS. 11B and 11C are plan views of the recessed portion of FIG. 9 according to additional embodiments of the present general inventive concept.
Figure 11C:
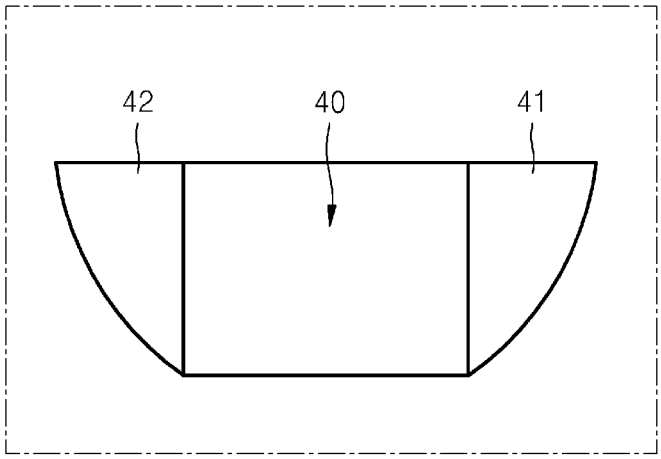

As illustrated in FIGS. 11B and 11C, respectively, the side walls 41 and 42 may have concave or convex shapes, as viewed from a top of the developer unit 100. In addition, the side walls 41 and 42 may have any other appropriate shape.

Figure 11D:
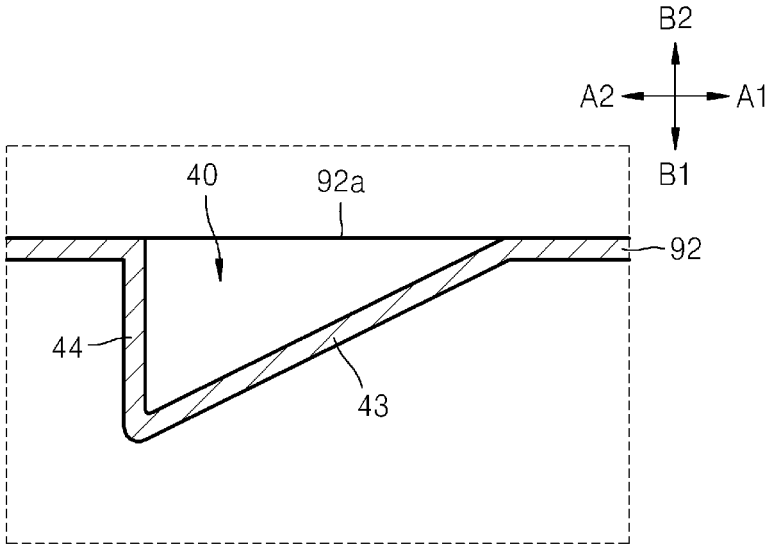
FIGS. 11D-11G are side cross-sectional diagrams of the recessed portion of FIG. 9 according to embodiments of the present general inventive concept.
Figure 11E:
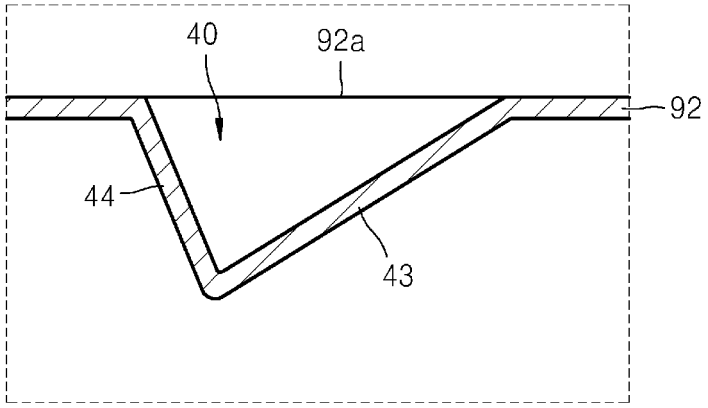

As further illustrated in FIGS. 11D and 11E, a height of the bottom surface 43 of the recessed portion 40 may gradually approach the support member 50 in a direction A2 from a front of the developer 100 to a rear of the developer 100. As illustrated in FIG. 11D, a rear wall 44 of the recessed portion may be a straight vertical line. Alternatively, FIG. 11E illustrates a slanted rear wall 44. In addition, the rear wall 44 may have a convex or concave shape.

Figure 11F:
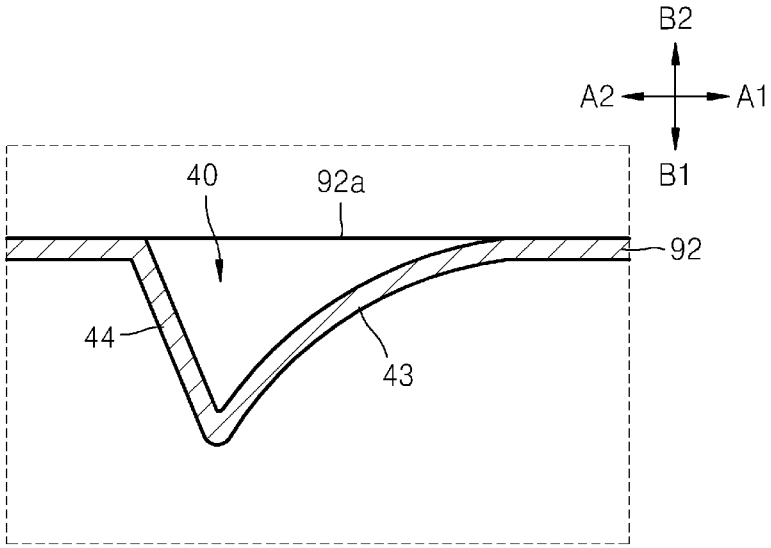
Figure 11G:
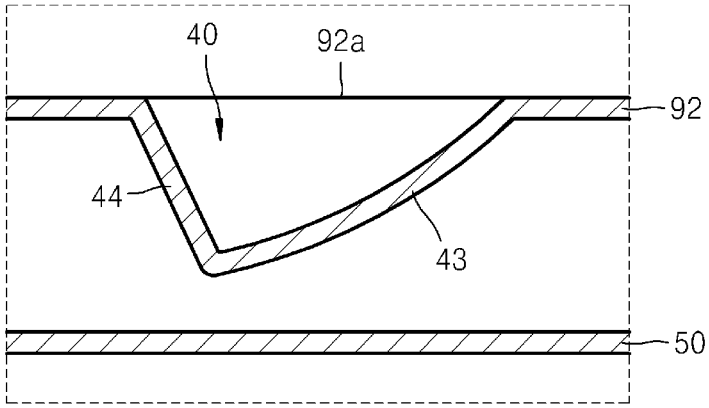

In addition, FIGS. 11F and 11G, respectively, illustrate that the bottom surface 43 of the recessed portion 40 may have a concave shape or a convex shape. In each case, the recessed portion 40 has a front surface in the direction A1 that is flush with the substantially planar outer wall 92*a*. Each location of the recessed portion 40 farther in the direction A2 from the front surface of the recessed portion 40 has a lower surface 43 than each location in the direction A1. In other words, a portion of the recessed portion 40 that is farther in the direction A2 towards the rear of the developer unit 100 is further recessed from the upper surface 92*a* and closer to the support member 50 than a portion farther in the direction A1.

As illustrated in FIG. 11A, the recessed portion 40 has a width W4 at its widest point, which is the point farthest in the rear direction A2. The width W4 may be less than a width of the upper frame 92 of the housing 90. For example, the width W4 may be one third or less the width of the upper frame 92 of the housing. Alternatively, since the recessed portion 40 reduces pressure corresponding to waste toner from the photoconductive unit or drum 1, the width W4 may be less than the width of the photoconductive drum 1, or the width W4 of the recessed portion may be one third or less the width of the photoconductive drum 1.

The recessed portion 40 may further have a length L2 in the front-back direction A1-A2. The length L2 of the recessed portion 40 may be less than a combined length of the cleaning unit or area 21 and the connecting unit or area 22. For example, a front end of the recessed portion 40 may begin over the cleaning area 21 and the rear end of the recessed portion 40 may end over the connecting area 22. Alternatively, the entire recessed portion 40 may be located over the connecting area 22.

Rollers such as the developing roller 3 and the supply roller 4 are installed in the housing 90. The developing and supply rollers 3 and 4 are exposed to the outside of the housing 90 so as to receive a rotation force. The exposed parts of the developing and supply rollers 3 and 4 may be finally supported by support plates 900 combined with side walls of the housing 90 as illustrated in FIG. 9.

Figure 12:
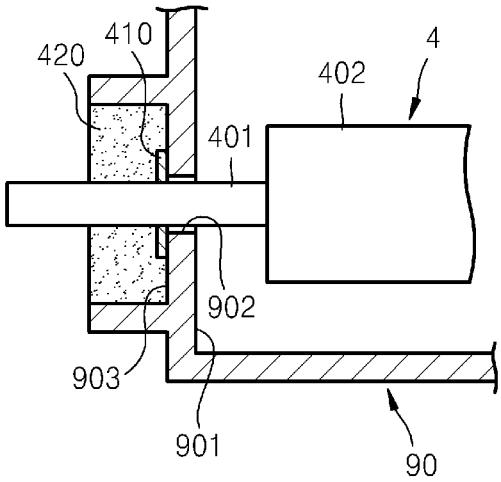
FIG. 12 is a cross-sectional diagram of a sealing structure of a supply roller.

For example, as illustrated in FIG. 12, the supply roller 4 may include a body 402 mounted on a rotation shaft 401. The body 402 may be an elastic body formed of, for example, urethane rubber. The rotation shaft 401 of the supply roller 4 is exposed to the outside through an insertion hole 902 in a side wall 901 of the housing 90. However, toner T contained in the housing 90 may leak through a gap between the rotation shaft 401 of the supply roller 4 and the insertion hole 902 and thus a sealing structure to prevent leakage of toner T is required.

In FIG. 12, a sealing member 420 is placed in the side wall 901 of the housing 90 in order to prevent leakage of toner T through a gap between the insertion hole 902 and the rotation shaft 401. The sealing member 420 according to the current embodiment is formed of a foam-type sealing material which is injected in a liquid state, instantly foamed, solidified, and formed into the sealing member 420. The foam-type sealing material may be a urethane form. A sealing washer 410 is interposed between the side wall 901 of the housing 90 and the sealing member 420 and blocks the liquid state foam-type sealing material from flowing into the housing 90 through the insertion hole 902, when the foam-type sealing material is injected.

Hereinafter, the sealing structure illustrated in FIG. 12 is described more fully.

Figure 13:
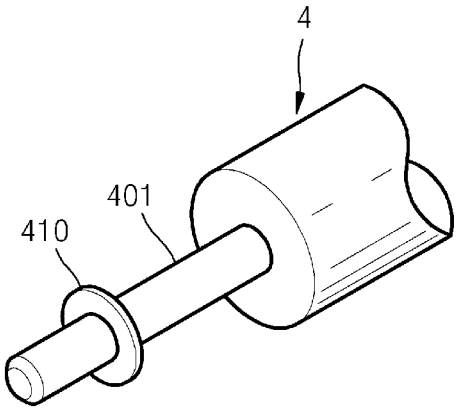
FIG. 13 is a perspective view of a supply roller in which a sealing washer is inserted on a rotation shaft thereof.

Firstly, as illustrated in FIG. 13, the sealing washer 410 is inserted on the rotation shaft 401 of the supply roller 4.

Figure 14:
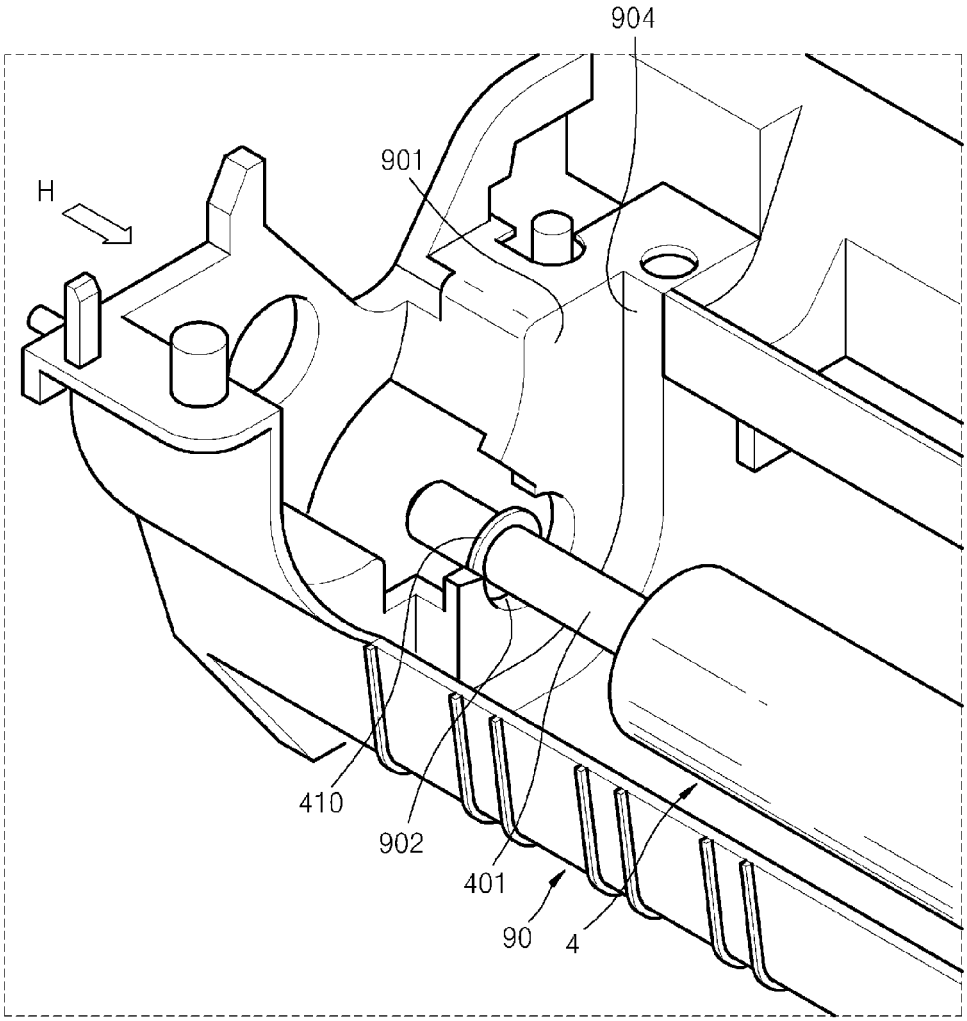
FIG. 14 is a perspective view showing a supply roller with a sealing washer mounted in a housing.

Then, the supply roller 4 is mounted to the housing 90. For example, the supply roller 4 may be mounted to the lower frame 91 before the lower frame has been connected with the upper frame 92. In FIG. 14, the insertion hole 902 may have a cut upper portion to allow the rotation shaft 401 to be easily inserted therein. Through the cut upper portion, the supply roller 4, to which the sealing washer 410 is attached, is mounted the housing 90. Then, the sealing washer 410 is pushed toward the rotation shaft 401, that is, in direction H, until it contacts an outside area 903 of the side wall 901 in FIG. 12.

Figure 15:
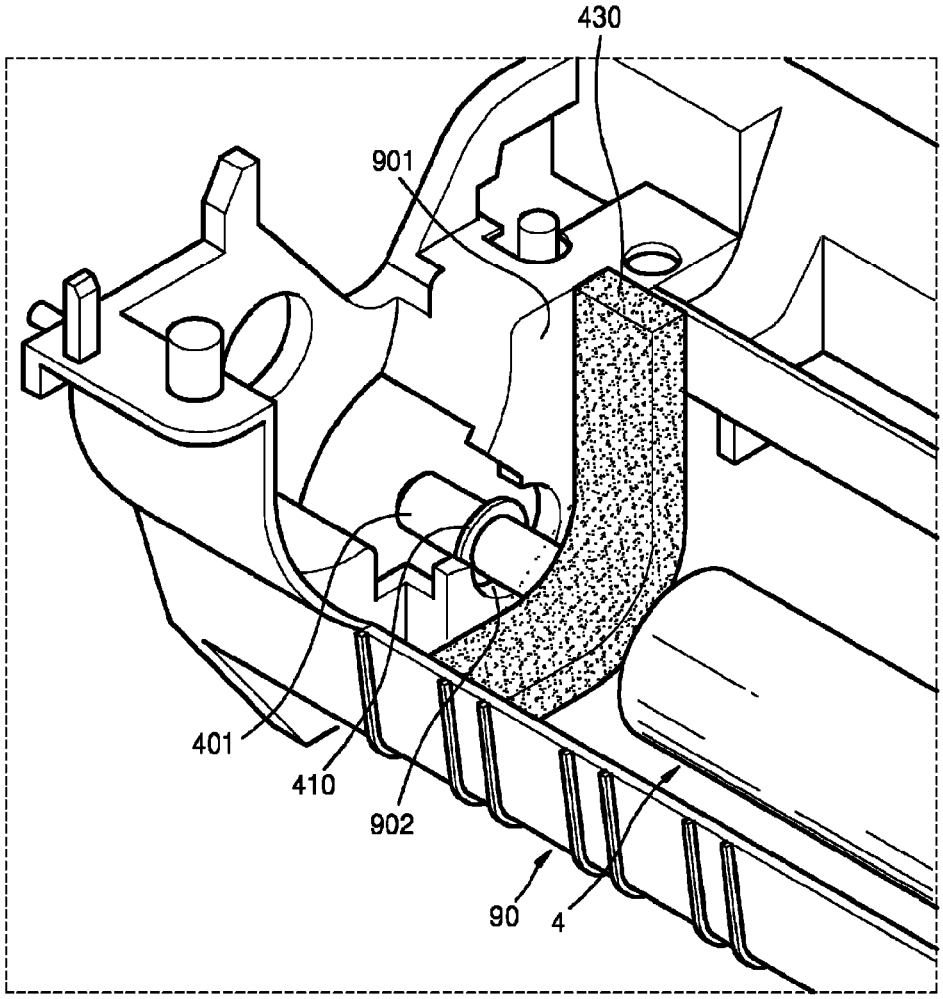
FIG. 15 is a perspective view showing a side sealing member attached to an adhesive surface in order to seal a developing roller.

Next, as illustrated in FIG. 15, an elastic side sealing member 430, for example, a sponge or rubber, may be attached to a contact surface 904 of FIG. 14 on the side wall 901, if necessary. The side sealing member 430 contacts the side-end portion of the developing roller 3 mounted to the housing 90 after assembling of the supply roller 4 is completed.

Figure 16:
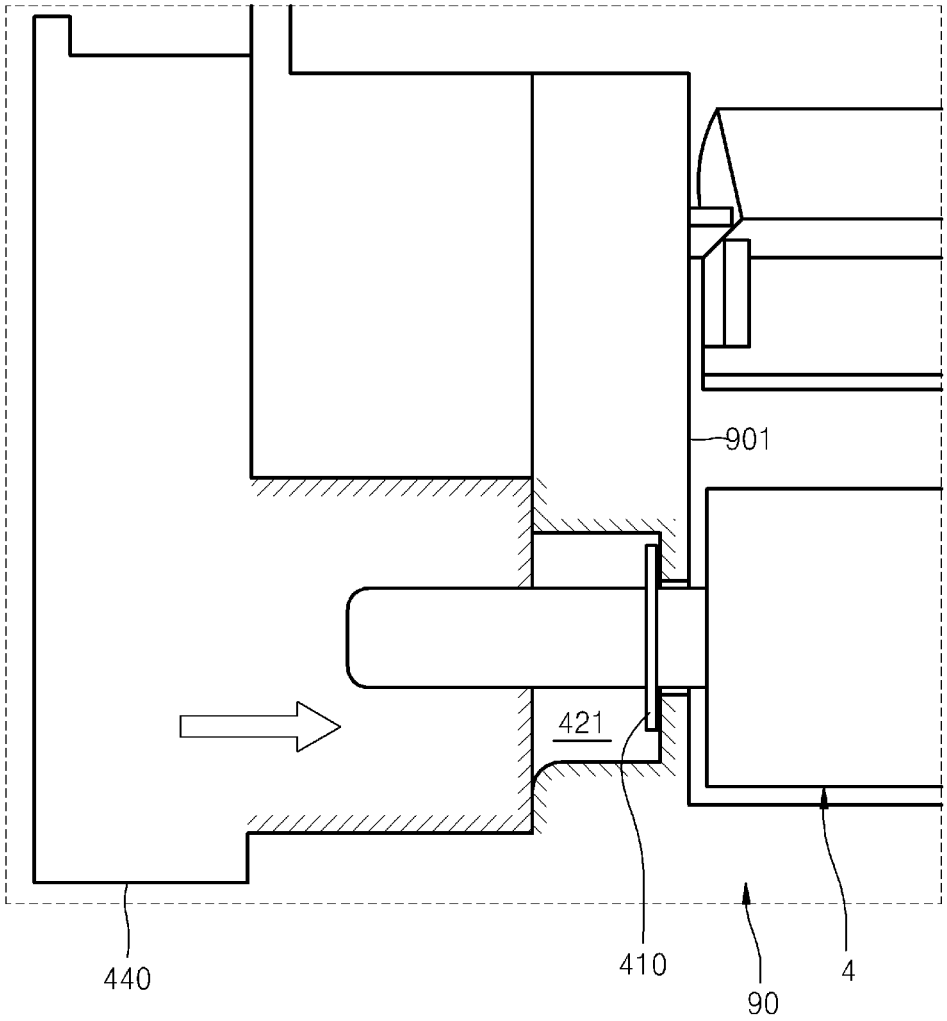
FIG. 16 is a diagram illustrating a mold forming a space for injecting a foam-type sealing material in a housing.

As illustrated in FIG. 16, a mold 440 is mounted to the housing 90. A liquid state foam-type sealing material is injected into a space 421 defined by the mold 440 and the side wall 901 of the housing 90. As the volume of the injected foam-type sealing material increases due to the foaming of the foam-type sealing material, the sealing washer 410 is pushed and adheres to the side wall 901. The foam-type sealing material is blocked by the sealing washer 410 and thus does not flow into the housing 90 over the side wall 901. The mold 440 supports the rotation shaft 401 of the supply roller 4 and may function as a jig that determines an installation location of the supply roller 4.

Figure 17:
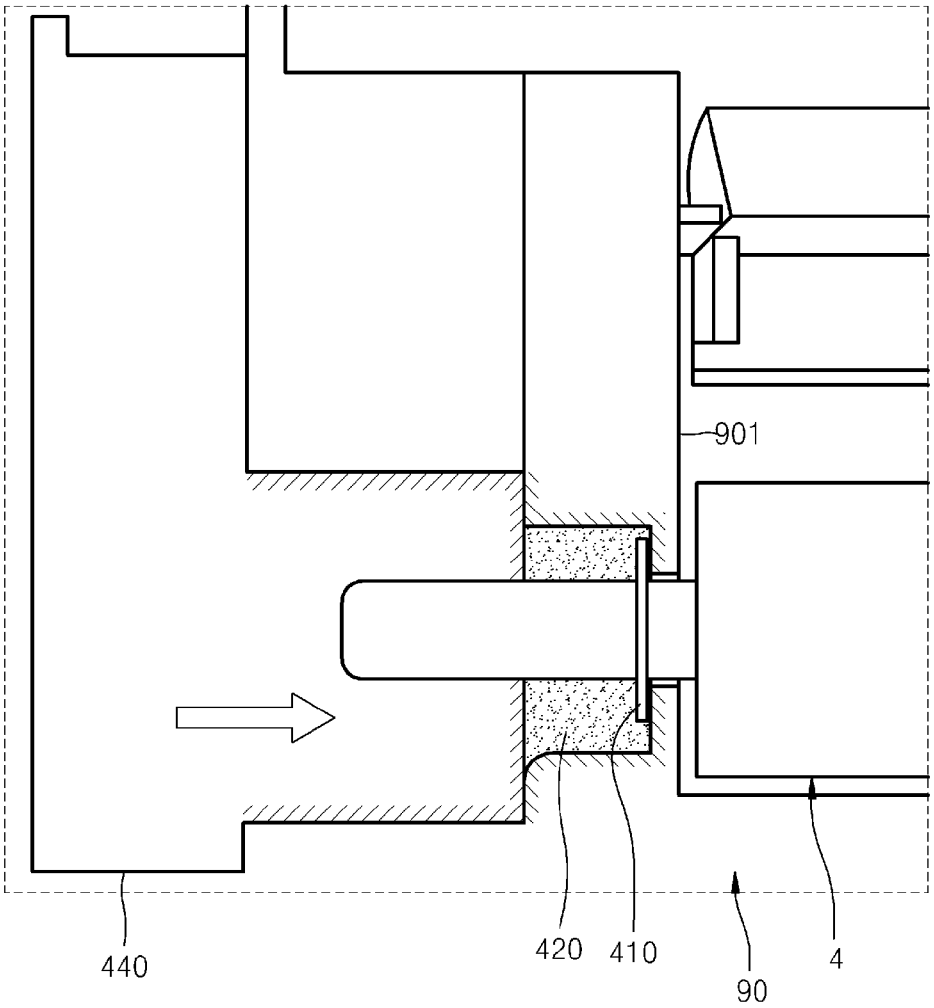
FIG. 17 is a diagram illustrating a sealing member formed by injecting a foam-type sealing material in a mold.

As the foam-type sealing material hardens, the space 421 is filled with the hardened sealing material and thus the sealing member 420 is formed as illustrated in FIG. 17. After forming of the sealing member 420 is completed, the mold 440 is removed. As described above, the sealing member 420 is located at the outside 903 of the side wall 901 of the housing 90 and thus may block toner T contained in the housing 90 from leaking to the outside of the housing 90 through the insertion hole 902. The sealing member 420 is strongly connected to the housing 90. Thus, when a rotation force is transmitted to the supply roller 4, the sealing member 420 is not rotated and only the supply roller 4 is rotated.

Figure 18:
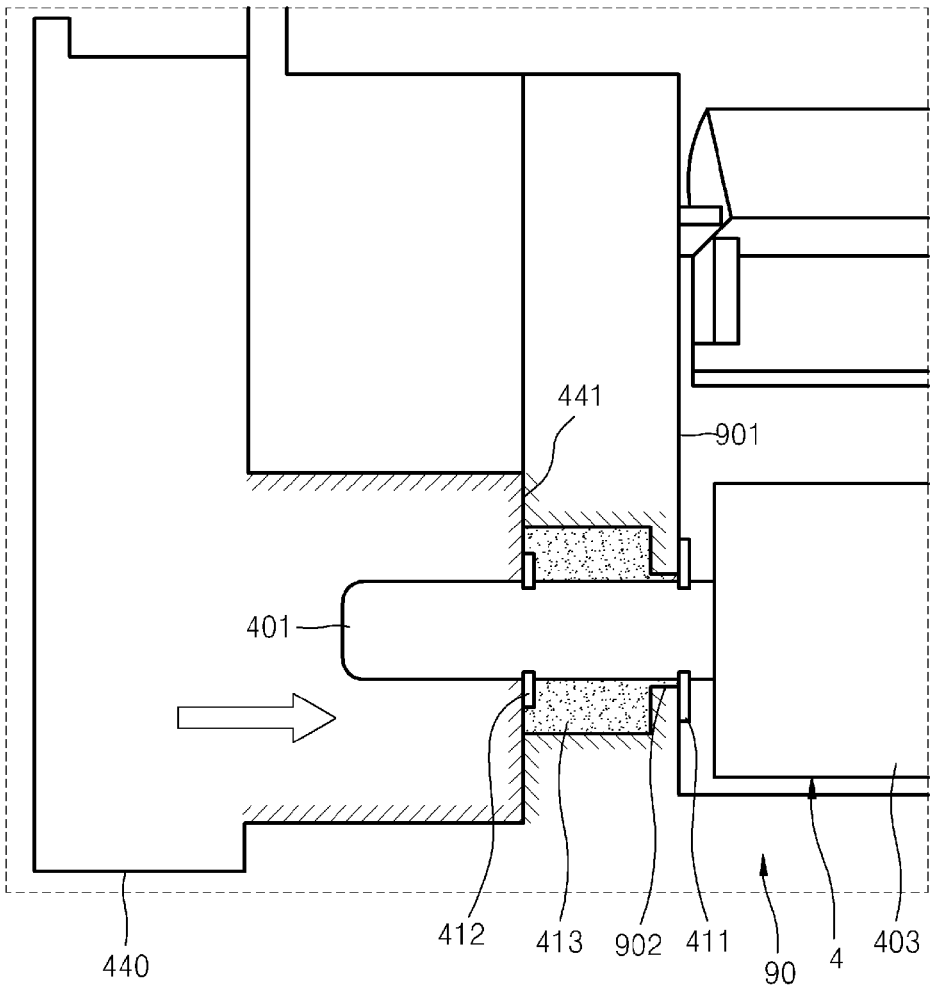
FIG. 18 is a general sealing structure including two sealing washers mounted on an end of a supply roller.

In contrast, as illustrated in FIG. 18, two sealing washers 411 and 412 may be combined with the rotation shaft 401 of the supply roller 4 and a foam-type sealing material may be injected between the sealing washers 411 and 412, thereby forming a sealing member 413. That is, the sealing washer 411 is disposed inside the side wall 901, or on a side of the side wall 901 opposite the sealing member 413, and the sealing washer 412 is disposed outside the side wall 901, or on an opposite side of the side wall 901 as the sealing washer 411. The mold 440 is pressed against the side wall 901, and the washer 412 may be positioned next to the surface 441 of the mold 440. The foam-type sealing material flows into the gap between the insertion hole 902 prepared in the side wall 901 and the rotation shaft 401 of the supply roller 4. The sealing washer 411 blocks the foam-type sealing material from contaminating the body 402 of the supply roller 4. As the sealing washer 411 is disposed inside the side wall 901 and contacts the sealing member 413 only via the gap in the insertion hole 902, the sealing washer 411 does not securely contact the sealing member 413. Accordingly, when the supply roller 4 is rotated, the sealing washer 411 may rotate with the supply roller 4. Then, broken pieces of the sealing member 413 may be generated by friction between the foam-type sealing material flowing to the inside of the side wall 901 through the gap between the insertion hole 902 and the rotation shaft 401 and the sealing washer 411. The broken pieces of the sealing member 413 may contaminate the photoconductive drum 1, developing roller 3, supply roller 4, and the regulator 5 included in the housing 90 and cause a printing error or a defect of the developer 100. Also, the sealing washer 412 located outside may be pushed to the outside when the sealing member 413 is formed. As there is no structure supporting the sealing washer 412, a bonding strength between the shaped sealing member 413 and the sealing washer 412 is weak. Accordingly, when the supply roller 4 is rotated, the sealing washer 412 is rotated along with the supply roller 4 and the sealing member 413 may be damaged, thereby deteriorating sealing efficiency.

However, according to the sealing structure described with reference to FIGS. 12 through 17, the sealing washer 410 is disposed in the outside area 903 of the side wall 901 and thus the liquid state foam-type sealing material does not flow to a gap between the insertion hole 902 and the rotation shaft 401 of the supply roller 4. Also, when the foam-type sealing material is foamed and shaped in the space 421, the sealing washer 410 receives a strong force between the foam-type sealing material and the side wall 901 and thus is strongly bonded with the formed sealing member 420. Accordingly, although the supply roller 4 is rotated, the sealing washer 410 is not rotated and thus broken pieces of the sealing member 420 due to friction between the sealing washer 410 and the sealing member 420 are not generated. In addition, although the supply roller 4 is rotated, the sealing member 420 is not damaged by the sealing washer 410 and thus the sealing effect of the sealing member 420 is maintained. Moreover, since only one sealing washer 410 is mounted to each end of the rotation shaft 401, the parts cost may be reduced compared with the general sealing structure illustrated in FIG. 18.

Figure 19:
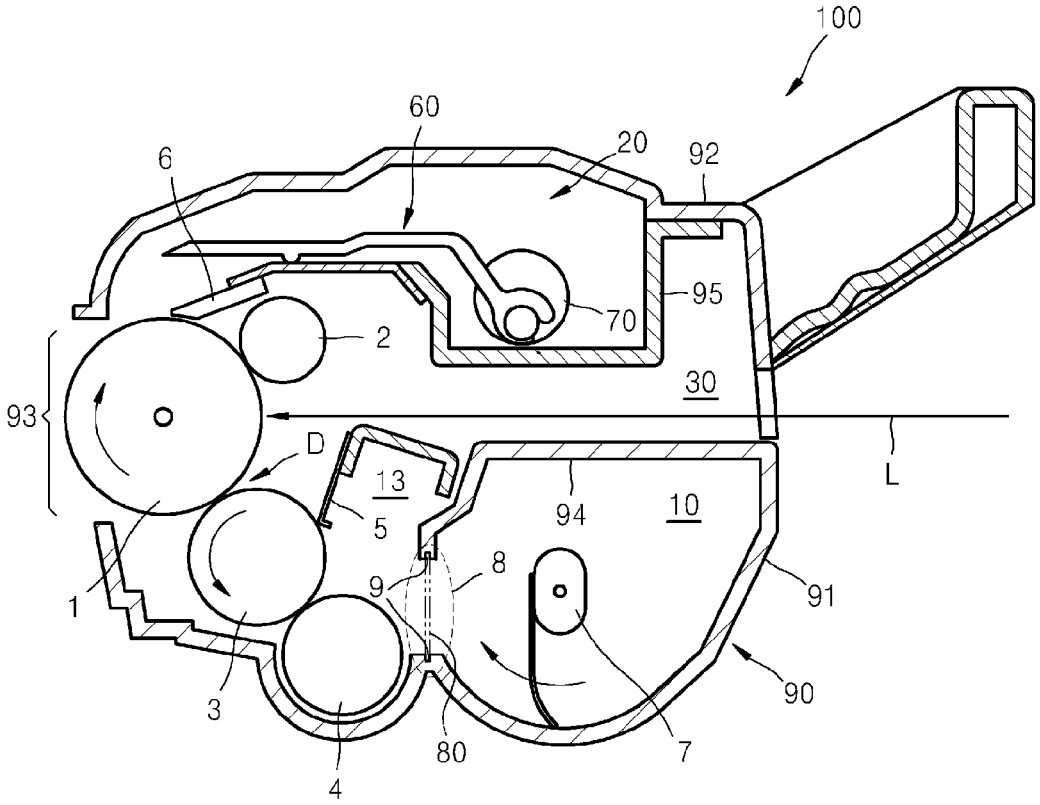
FIG. 19 is a diagram of a developer according to an embodiment of the present general inventive concept.

According to an embodiment of the present general inventive concept, the developer 100 is replaceable, and thus may be distributed separately from the main body 700 of the image forming apparatus. Referring to FIG. 19, a developing portion 13 in which the developing roller 3 is installed is connected to the toner container 10, which contains toner T, via a toner supply window 8. When the toner container 10 and the developing portion 13 are connected to each other, the toner T may leak through the opening 93 during a distribution or handling process. Thus, as illustrated in FIG. 19, the toner supply window 8 is closed using a blocking member 80 so that the toner container 10 and the developing portion 13 may be separated from each other. The blocking member 80 is removed before the developer 100 is mounted on the main body 700, so that the toner container 10 and the developing portion 13 may be connected to each other via the toner supply window 8. Then, the toner T contained in the toner container 10 may be supplied to the developing portion 13.

In a conventional developer, a barrier wall member (not illustrated) to which a blocking film (not illustrated) is attached is fused on the toner supply window 8, and part of the blocking film is exposed to the outside of the housing 90. In the conventional developer, the toner container 10 and the developing portion 13 are connected to each other by removing the blocking film by pulling out the exposed part of the blocking film. Thus, in the conventional developer, a process of attaching the blocking film to the barrier wall member and a process of fusing the barrier wall member on the inside of the housing 90 need to be performed, and thus the manufacturing costs increase. In addition, since the toner container 10 and the developing portion 13 are completely separated from each other, toner T for a performance test of the developer needs to be loaded into the developing portion 13 so as to carry out the performance test of the developer. To this end, a loading hole (not illustrated) through which the toner T for the performance test is loaded into the developing portion 13 needs to be formed in the housing 90, and after the performance test is completed, a process of closing the loading hole needs to be performed.

Figure 20:
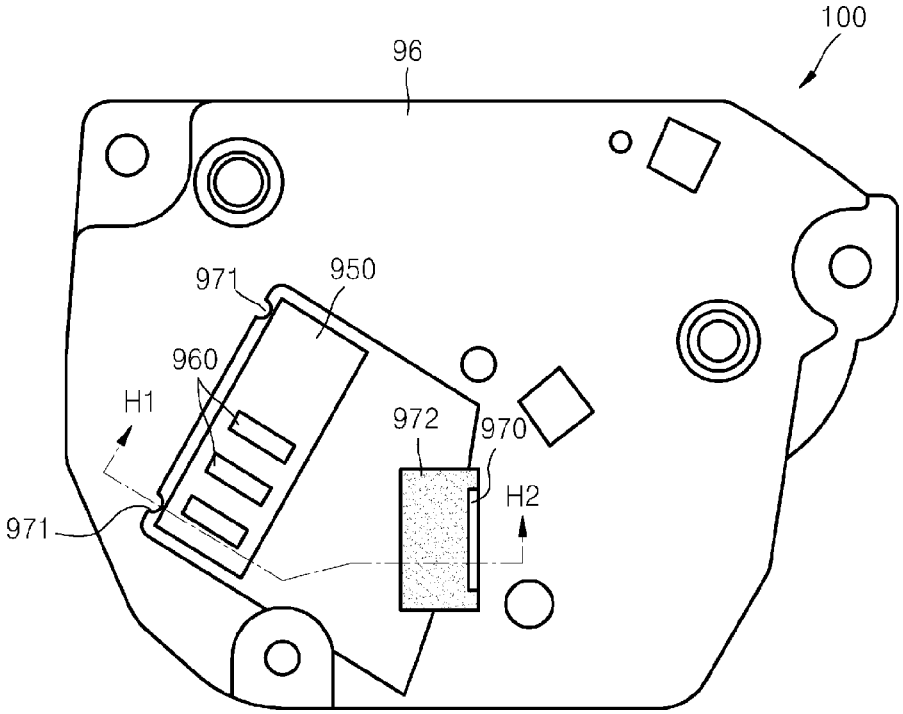
FIG. 20 is a side view of the developer of FIG. 19.

In the developer 100 according to the present general inventive concept, the blocking member 80 is inserted in the inside of the housing 90 from the outside of the housing 90, thereby closing the toner supply window 8. Referring to FIG. 19, a pair of rails 9 are disposed on the toner supply window 8 and extend in a side-to-side lengthwise direction F1-F2 of the developing roller 3. The rails 9 extend along upper and lower edges of the toner supply window 8. Referring to FIG. 20, an insertion hole 970 is formed in outer sidewalls 96 of the housing 90 to be aligned with the rails 9. The outer sidewalls 96 are side walls that form the outmost walls of the housing 90. For example, the outer sidewalls 96 may be the support plates 900 of FIG. 9 that are combined with the side walls 901 and support the developing roller 3 and the charging roller 2 installed in the developer 100. In this case, the insertion hole 970 is formed by penetrating the outer sidewalls 96 and the side walls 901.

Figure 21:
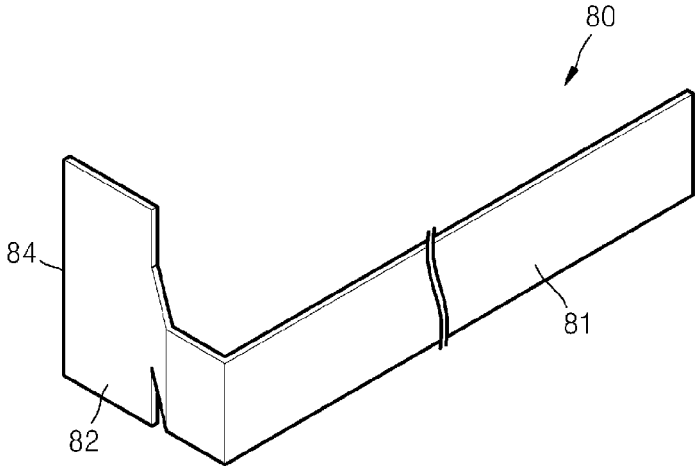
FIG. 21 is a perspective view of a blocking member according to an embodiment of the present general inventive concept.

Referring to FIG. 21, the blocking member 80 includes a blocking portion 81 that is inserted in the rails 9 and closes the toner supply window 8, and a bent portion 82 that is bent from the blocking portion 81. The bent portion 82 is disposed at the outside of the housing 90 while the blocking portion 81 is inserted in the rails 9. The bent portion 82 may serve as a handle when the blocking portion 81 is removed from the rails 9.

Figure 22:
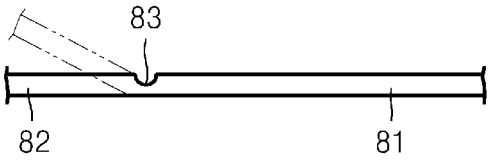
FIG. 22 is a side view of the blocking member of FIG. 21 in which a bending line is formed.

The blocking member 80 may be manufactured by cutting a flexible board that may be elastically bent in a desired form. After the board is cut in the desired form, the bent portion 82 (or the portion-to-be-bent) may be bent parallel to outer sidewalls 96 of the housing 90, as illustrated in FIG. 21. In addition, after the board is cut in the desired form, a bent line 83 may be formed so that the bent portion 82 may be bent with respect to the blocking portion 81 along the bending line 83, as illustrated in FIG. 22. The bending line 83 may be formed to be recessed from the surface of the blocking member 80, such as a notch, for example. In this case, after the blocking portion 81 is inserted in the rails 9, the bent portion 82 may be bent parallel to the outer sidewalls 96 of the housing 90 along the bending line 83. Manufacturing of the blocking member 80 is not limited to the above-described method, and the blocking member 80 may be manufactured using various methods including plastic injection molding or the like.

Referring to FIGS. 20 and 23, a securing portion 971 is disposed on the outer sidewalls 96. The securing portion 971 secures the bent portion 82 on the outer sidewalls 96 while the blocking portion 81 is inserted in the rails 9 and the bent portion 82 is bent in a direction parallel to the outer sidewalls 96. The securing portion 971 may be in the form of a protrusion so that the securing portion 971 may catch the edges 84 of the bent portion 82 so that a predetermined force is required to remove the blocking member 80 from the developer 100. For example, the securing portion 971 may be designed to overlap the edge of the bent portion 82 sufficiently so that a small shaking force or a gravity force are not sufficient to remove the blocking member 80 from the developer 100, but an intentional force may be required.

The developer 100 may include a communication unit which is electrically connected to the main body 700 of the image forming apparatus and transmits information about the developer 100 to the main body 700 of the image forming apparatus when the developer 100 is installed in the main body 700 of the image forming apparatus. The communication unit may include a customer replaceable unit monitor (CRUM) unit 950 which may monitor and manage a state of the developer 100. The CRUM unit 950 may be, for example, installed to the outer sidewalls 96 of the housing 90 in the developer 100.

Figure 27:
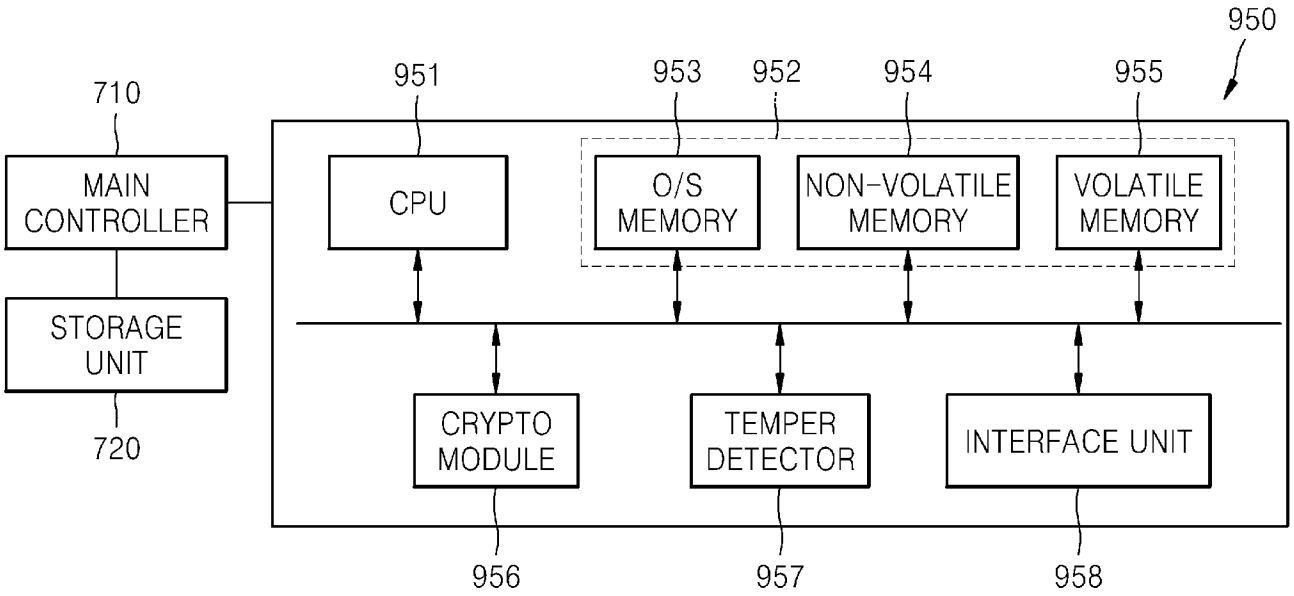
FIG. 27 is a block diagram of a CRUM unit according to an embodiment of the present general inventive concept.

FIG. 27 is a block diagram of CRUM 950 unit according to an embodiment of the present general inventive concept. Referring to FIG. 27, the CRUM unit 950 may include a central processing unit (CPU) 951 which performs at least one of authentication and/or encrypted data communication with the main body 700 of the image forming apparatus by using its own operating system (O/S). The CRUM unit 950 may further include a memory unit 952. The CPU 951 may manage the memory unit 952 by using the O/S. The O/S is prepared for driving the developer 100 and denotes software for operating general application programs. The CPU 951 may perform initialization by using the O/S separately from a main controller 710.

Various types of information related to the developer 100 may be stored in the memory unit 952. For example, information about a manufacturer, information about manufactured date, unique information such as a serial number and model name, various programs, electronic signature information, and information about the use condition (for example, the number of pages printed up to date, the number of printable pages remained, and a remaining amount of toner T) may be stored in the memory unit 952. Also, information about life of the developer 100 and setup menu may be stored in the memory unit 952.

The CRUM unit 950 may further include a crypto module 956, a temper detector 957, and an interface unit 958. Although not illustrated, the CRUM unit 950 may further include a clock unit and a random value generator, wherein the clock unit generates a clock signal and the random value generator generates a random value for authentication. The CRUM unit 950 may be in the form of a chip only including the CPU 951 or a chip including the memory unit 952 and the CPU 951. When the CRUM unit 950 is formed as a chip only including the CPU 951, the O/S may be provided from an external memory.

The crypto module 956 allows the CPU 951 to perform authentication and encrypted data communication with the main controller 710 by supporting an encryption algorithm. For example, the crypto module 956 may support any algorithm from among four encryption algorithms such as ARIA, TDES, SEED, and AES symmetric key algorithms. Accordingly, the main controller 710 needs to support all four encryption algorithms. The main controller 710 may identify an encryption algorithm used in the CRUM unit 950, perform authentication by using the identified encryption algorithm, and then perform encrypted data communication. The temper detector 957 is used to defend various physical hacking attempts, that is, tempering, and monitors an operational environment such as voltage, temperature, pressure, frequency, and the like. Thus, when an attempt such as decap is made, the temper detector 957 removes data or physically blocks the decap. As the crypto module 956 and the temper detector 957 are included in the CRUM unit 950, systematic data security may be accomplished by using both hardware and software.

The memory unit 952 may include at least one of the group consisting of an O/S memory 953, a non-volatile memory 954, and a volatile memory 955. The O/S is stored in the O/S memory 953. Various data is stored in non-volatile memory 954. For example, various information such as electronic signature information, various encryption algorithm information, and information about a state of the developer 100 (for example, remaining amount of toner T, replacement date, the number of remaining pages to be printed, information about a manufacturer, manufactured date, serial number, product model name, and A/S information) may be stored in the non-volatile memory 954. The volatile memory 955 may be used as a temporary storage needed in an operation. These memories may be realized in an internal memory included in the CPU 951.

The interface unit 958 connects the CPU 951 to the main controller 710. For example, the interface unit 958 may be a serial interface or a wireless interface. With a serial interface, fewer signal connections are required compared with a parallel interface and thus a cost may be reduced. Also, the serial interface is appropriate in an operational environment having electronic noise, such as a printer.

The CPU 951 performs initialization when a specific event is performed, for example, when power of the image forming apparatus is turned on or when the CRUM unit 950 or the developer 100 is separated from the main body 700 of the image forming apparatus and is installed again in the main body 700 of the image forming apparatus. The initialization may include initially operating various application programs used in the CRUM unit 950, calculating private information needed in data communication with the main controller 710 of the main body 700 of the image forming apparatus after the initialization, setting up a communication channel, initializing a memory value, identifying replacement time, setting a register value in the CRUM unit 950, and setting internal and external clock signals.

In the setting of the register value, functional register values in the CRUM unit 950 are set so that the CRUM unit 950 may operate in correspondence to various functional states that are previously set by a user. Also, in the setting of the internal and external clock signals, frequency of the external clock signal provided from the main controller 710 of the main body 700 of the image forming apparatus is adjusted to match the internal clock signal used in the CPU 951 of the CRUM unit 950. In the identifying of the replacement time, a remaining amount of toner T that is used so far is identified to estimate a final exhaustion time and the final exhaustion time is notified to the main controller 710. In the initialization, when it is determined that a remaining amount of toner T is already exhausted, the CRUM unit 950 may inform the main controller 710 a state that an operation is impossible after the initialization is completed. Since the CRUM unit 950 includes the CPU 951 and its own O/S, data regarding the remaining amounts or refilling numbers of consumable supplies stored in the memory unit 952 may be identified before the main controller 710 requests communication with the CRUM unit 950 when power of the main body 700 of the image forming apparatus is turned on. Accordingly, the time required to determine whether there is a lack of consumable supplies may be reduced compared to a device in which the data is calculated based on a request from the main controller 710. For example, if toner T is not enough, a user may allow formation of an image by converting a mode into a toner saving mode directly after power is on The CPU 951 does not respond to a command of the main controller 710 until the initialization is completed. The main controller 710 waits for a response of the CPU 951 by periodically transmitting a command to the CPU 951 until the response of the CPU 951 is received. When the response is received in the main controller 710, authentication is performed between the main controller 710 and the CPU 951.

Due to the O/S installed in the CRUM unit 950, authentication may be performed through an interaction between the CRUM unit 950 and the main controller 710 of the main body 700 of the image forming apparatus. The main controller 710 of the main body 700 of the image forming apparatus may perform initialization of the image forming apparatus separately from the initialization of the CRUM unit 950. In this case, due to a size of the system, initialization of the CRUM unit 950 is completed before the initialization of the image forming apparatus. When the initialization of the CRUM unit 950 is completed, the CRUM unit 950 may operate an encryption algorithm as the CRUM unit 950 includes the O/S. That is, the encryption algorithm is operated in response to the command from the main controller 710, and bi-directional authentication between the main controller 710 and the CRUM unit 950 may be accomplished instead of one-directional authentication of the main controller 710 according to the operation of the encryption algorithm.

The authentication may be accomplished by using various methods. For example, the main controller 710 transmits a command requesting authentication to the CPU 951 when a response is received from the CPU 951. In this case, the main controller 710 may transmit an arbitrary random value R1 to the CPU 951 along with the command. When the CPU 951 receives the command requesting authentication and the random value R1, the CPU 951 generates a session key by using a random value R2 generated by itself and the received random value R1 and generates a message authentication code (MAC) by using the generated session key. Then, the CPU 951 transmits the generated MAC, previously stored electronic signature information, and the random value R2 to the main controller 710.

When it is identified that the received electronic signature information is correct by examining the received electronic signature information, the main controller 710 generates a session key by itself by using the received random value R2 and the previously generated random value R1 and generates a MAC by using the generated session key. The MAC is examined by identifying whether the generated MAC is the same as the received MAC. According to the examination result, whether the authentication succeeds is determined. As such, information for authentication or a random value while transmitting the command may be applied to oppose to malicious seizure attempts from a third party.

When the authentication succeeds, the main controller 710 and the CPU 951 of the CRUM unit 950 perform encrypted data communication. The CRUM unit 950 has its own O/S and thus may execute an arbitrary encryption algorithm. Accordingly, the encryption algorithm is applied to data transmitted from the main controller 710 so as to detect a MAC and thus justification or verification of the data is determined. When it is determined that the data is verified, an operation according to the data is performed. When it is determined that the data is incorrect, the data may be removed directly after being received. In this case, the controller 710 may be notified of a problem in data communication.

The encrypted data communication is performed in such a way that an encrypted MAC is transmitted along the data to be transmitted by using the previously set encryption algorithm and key. The data to be transmitted is changed each time and thus the MAC transmitted with the data is also changed each time. Accordingly, even if a third party intervenes in the data communication and identifies the MAC, the third party may not hack into subsequent data communication by using the MAC and thus the data communication is strongly secured. A storage unit 720 stores a key value needed in authentication, a plurality of encryption algorithms, information about the developer 100, and information about the use condition of the developer 100.

The main controller 710 may access a memory in the CRUM unit 950 after the main controller 710 transmits an access command to the CPU 951 included in the CRUM unit 950 and receives a response from the CPU 951. In this regard, the CRUM unit 950 is different from a general CRUM unit which is only formed of a memory and performs simple reading/recording operation of data.

When a printing operation is completed, the main controller 710 produces information about use of toner T and stores the information in the storage unit 720. Also, the information about use of toner T may be transmitted to the CRUM unit 950. Accordingly, when a specific event (for example, when the main body 700 of the image forming apparatus is reset or when it is determined that toner T is exhausted) is generated or when a certain period comes, information about the consumable supplies is compared in the storage unit 720 and the CRUM unit 950 so as to identify whether data is normally recorded in the CRUM unit 950 and to accurately manage the replacement time of the developer 100.

The CRUM unit 950 may include a plurality of electrical contact point portions 960 for electrically connecting to the main body 700.

In the developer 100 according to the present general inventive concept, the bent portion 82 may also serve as a protection portion that covers and protects the communication unit including the CRUM unit 950. In detail, as illustrated in FIG. 23, the bent portion 82 may cover an upper portion of the CRUM unit 950 while being bent parallel to the outer sidewalls 96 of the housing 90. The securing portion 971 may secure the bent portion 82 on the outer sidewalls 96 when the bent portion 82 covers the CRUM unit 950.

Figure 23A:
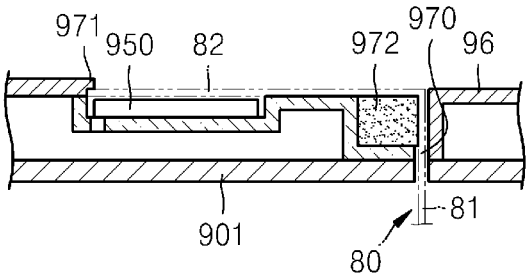
FIGS. 23A and 23B are cross-sectional diagrams of the developer of FIG. 19 cut along the line H1-H2 of FIG. 20.
Figure 23B:
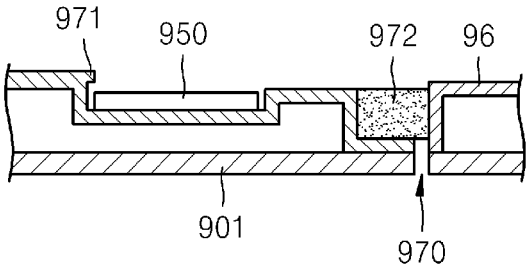

As illustrated in FIGS. 23A and 23B, the developer 100 according to the present general inventive concept may further include a toner leakage prevention member 972 that prevents leakage of the toner T via the insertion hole 970. The toner leakage prevention member 972 may be an elastic member such as a sponge or the like. The toner leakage prevention member 972 may be attached to the outer sidewalls 96 of the housing 90 by using a double-sided tape so as to cover at least part of the insertion hole 970. The blocking member 80 may be inserted in the housing 90 via the insertion hole 970 while pushing the toner leakage prevention member 972.

As illustrated in FIG. 23A, when the blocking member 80 is inserted into the insertion hole 970, the toner leakage prevention member 972 presses against the blocking member 80 to prevent any leakage of toner. As illustrated in FIG. 23B, when the blocking member 80 is removed from the insertion hole 970, the elastic nature of the toner leakage prevention member 972 causes the toner leakage prevention member 972 to expand to cover the insertion hole 970 to prevent toner from leaking from the insertion hole 970.

Figure 24:
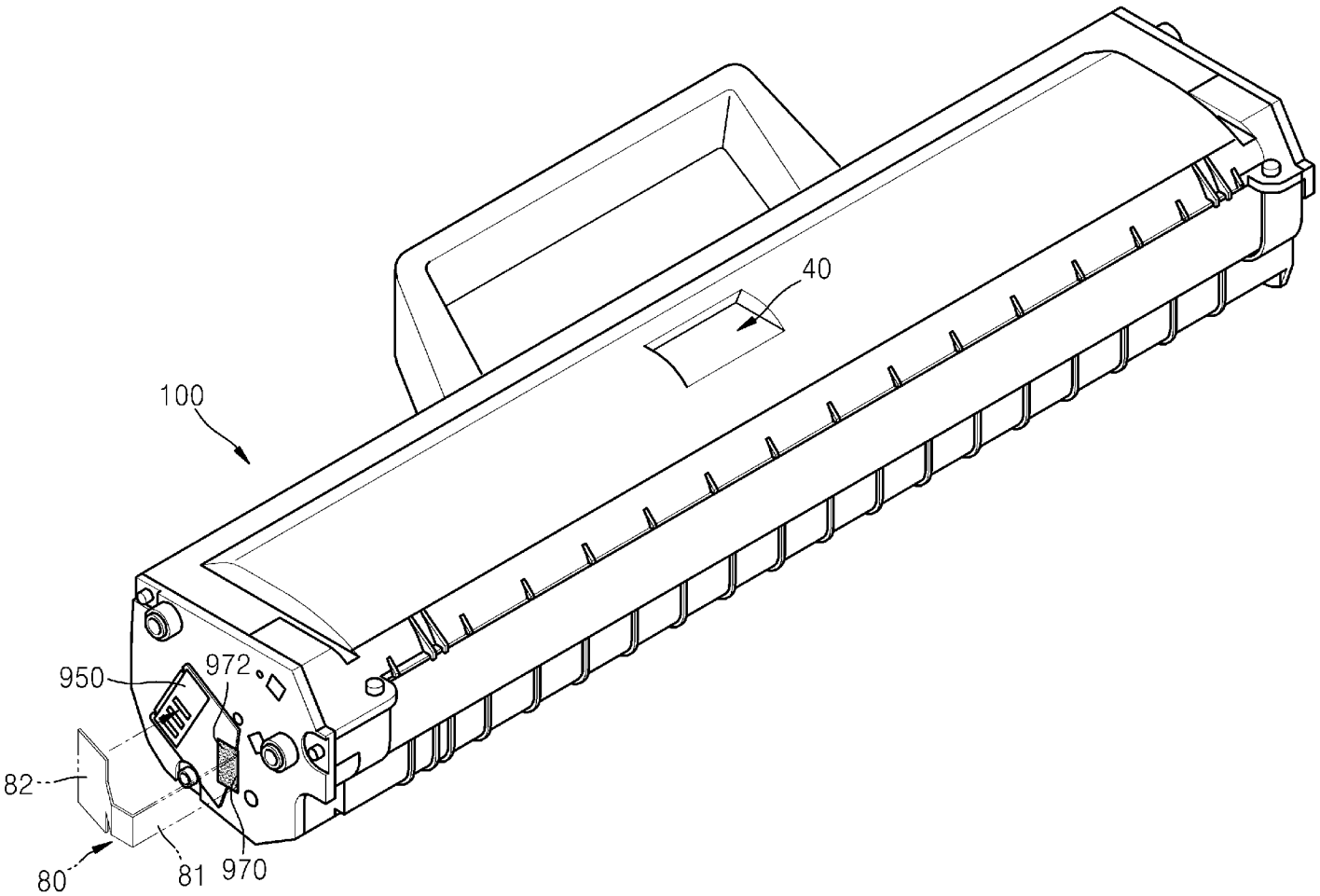
FIG. 24 is a perspective view of the developer of FIG. 19 in which a blocking member is inserted to a housing through an insertion hole prepared on an outer side wall of the housing.
Figure 25:
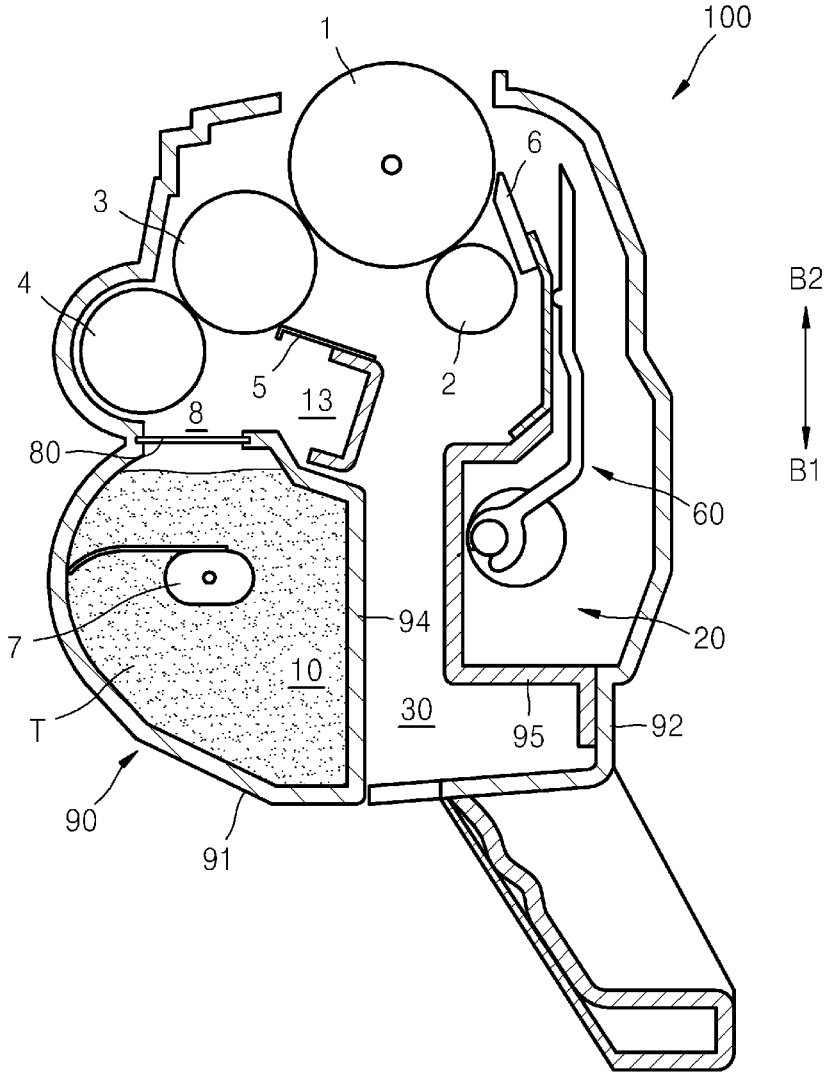
FIG. 25 is a cross-sectional diagram of the developer of FIG. 19 which stands to collect toner in a developing unit in a toner container after a performance test.

The toner T is charged in the toner container 10 while the blocking member 80 is not installed at the developer 100 after the developer 100 has been manufactured. Then, as illustrated in FIG. 19, the toner container 10 is connected to the developing portion 13 via the toner supply window 8. The performance test of the developer 100 is performed in this state. When the performance test is completed, as illustrated in FIG. 24, the blocking member 80 is inserted in the rails 9 through the insertion hole 970. In this case, the toner T does not need to remain on the developing portion 13. To this end, as illustrated in FIG. 25, the blocking member 80 may be inserted in the rails 9 while the developing portion 13 is oriented upwards and the toner T contained in the developing portion 13 is recovered to the toner container 10. In other words, if the direction B2 corresponds to the ground and the direction B1 is opposite B2, then the developer may be oriented to that the opening 93 faces the direction B1 and the container 20 is oriented in the direction B2 with respect to the opening 93.

Figure 26:
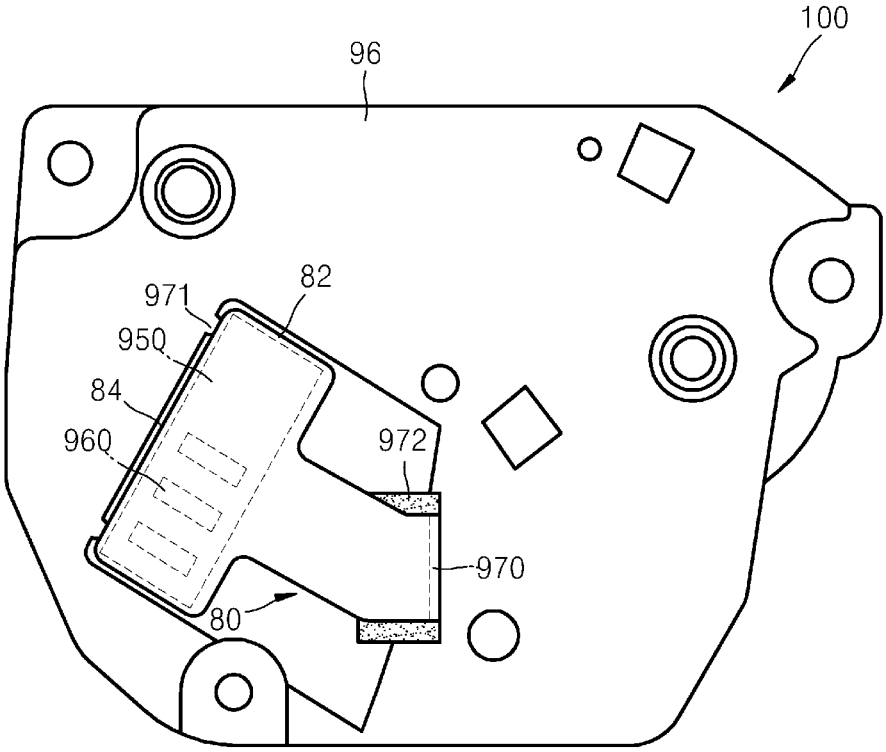
FIG. 26 is a side view of the developer of FIG. 19 in which a bend portion of a blocking member covers a customer replaceable unit monitor (CRUM) unit.

When the blocking portion 81 is completely inserted in the rails 9, the toner supply window 8 is closed so that the toner container 10 and the developing portion 13 may be isolated from each other. As illustrated in FIG. 23, the bent portion 82 is disposed parallel to the outer sidewalls 96 of the housing 90, and the edges 84 of the bent portion 82 are caught in the securing portion 971, thereby securing the bent portion 82 on the outer sidewalls 96. Then, as illustrated in FIG. 26, the bent portion 82 is secured on the outer sidewalls 96 while covering the CRUM unit 950, thereby preventing damage of the CRUM unit 950 due to physical or electrical shock during the distribution process.

The bent portion 82 is released from the securing portion 971 before the developer 100 is mounted on the main body 700 of the image forming apparatus, and the bent portion 82 is grasped and pulled out in an opposite direction to a direction in which the bent portion 82 is inserted, and the blocking member 80 is removed from the housing 90. Then, the toner container 10 and the developing portion 13 are connected to each other via the toner supply window 8. Next, when the developer 100 is mounted on the main body 700 of the image forming apparatus, the CRUM unit 950 may be electrically connected to the main body 700 and may transmit information about the developer 100 to the main body 700.

Although a monochromic image forming apparatus including one developer 100 has been illustrated in the previous embodiments, the scope of the present general inventive concept is not limited thereto. In the case of a color image forming apparatus, four developers 100 in which toners having colors such as cyan (C), magenta (M), yellow (Y), and black (K) are contained, may be employed.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developer attached to and detached from a main body of an image forming apparatus, the developer comprising:

a photoconductor to have an image formed thereon; and a housing comprising a waste toner container to receive waste toner from the photoconductor;

wherein the housing includes an upper wall at a top of the housing, the upper wall having a recessed portion depressed downwardly in a center portion of the upper wall of the waste toner container, the center portion corresponding to a portion of a center of the photoconductor in a lengthwise direction.

2. The developer of claim 1, wherein a gap between side walls of the recessed portion in the lengthwise direction of the photoconductor gradually decreases in a downward direction.

3. The developer of claim 2, wherein the waste toner container comprises a cleaning unit including a cleaning member, and a container spaced apart from the cleaning unit, the waste toner container contains the waste toner transferred from the cleaning unit by a waste toner transporting member, and a gap between the side walls of the recessed portion in the lengthwise direction gradually increases from in the front-to back direction from the cleaning unit toward the container.

4. The developer of claim 3, wherein the waste toner transporting member moves back and forth along the front-to-back axis and upward and downward.

5. The developer of claim 4, further comprising:

a rotation member located within the container of the waste toner container, the rotation member comprising an eccentricity unit to have an eccentric rotation path around a center of rotation of the rotation member, wherein the housing comprises a support unit of which at least a part thereof is inclined upward toward the container from the cleaning unit, and the waste toner transporting member comprises a support protrusion that contacts the support unit by sliding, an end part of the waste toner transporting member being attached to the eccentricity unit and moving back and forth and upward and downward due to a rotation of the rotation member.

6. The developer of claim 5, wherein the waste toner transporting member comprises a plurality of horizontal ribs that are spaced apart from each other in a direction of the back-and-forth movement and a plurality of spaces between the ribs to accommodate waste toner to be transported from the cleaning unit to the waste toner container.

7. The developer of claim 6, wherein widths of the spaces gradually decrease in the direction from front to back from the cleaning unit toward the container of the waste toner container.

8. The developer of claim 1, further comprising a customer replaceable unit monitor (CRUM) unit comprising a central processing unit (CPU) which performs at least one of authentication and encrypted data communication with the main body of the image forming apparatus by using its own operating system (O/S).

9. The developer of claim 1, wherein the housing comprises a toner container containing toner, a developing portion, in which a developing roller for supplying toner to the photoconductor is installed, and a toner supply window connecting the toner container to the developing portion, and wherein the developer comprises:

a pair of rails disposed on the toner supply window and extending in a lengthwise direction of the developing roller; and a blocking member comprising a blocking portion which opens/closes the toner supply window by being inserted to or removed from the pair of rails from the outside of the housing via an insertion hole located on an outer sidewall of the housing to be aligned with the rails.

10. The developer of claim 9, wherein the blocking member comprises a bent portion extended from the blocking portion and disposed at the outside of the housing while the blocking portion is inserted in the rails.

11. The developer of claim 10, further comprising a customer replaceable unit monitor (CRUM) unit comprising a central processing unit (CPU) which performs at least one of authentication and encrypted data communication with the main body of the image forming apparatus by using its own operating system (O/S), wherein electrical connections of the CRUM unit are exposed to the outside via the outer sidewalls of the housing to electrically connect to the main body of the image forming apparatus, and the bent portion covers the electrical connections of the CRUM unit while the blocking portion is inserted in the rails.

12. The developer of claim 11, wherein the bent portion is bent parallel to the outer sidewalls of the housing.

13. The developer of claim 11, wherein the bent portion is divided from the blocking portion by a bending line and is bent parallel to the outer sidewalls of the housing along the bending line.

14. The developer of claim 11, further comprising a securing portion disposed on the outer sidewalls of the housing, the securing portion securing the bent portion while the blocking portion covers the CRUM unit.

15. An electrophotographic image forming apparatus comprising:

a main body; and a developer attached to and detached from the main body, wherein the developer comprises:

a photoconductor; and a housing comprising a waste toner container to receive waste toner from the photoconductor, wherein the housing includes an upper wall including at a top of the housing, the upper wall having a recessed portion depressed downwardly from a substantially planar surface of the upper wall, the center portion corresponding to a portion of a center of the photoconductor in a lengthwise direction.

16. The apparatus of claim 15, wherein a gap between side walls of the recessed portion in the lengthwise direction of the photoconductor gradually decreases in a downward direction.

17. The apparatus of claim 16, wherein the waste toner container comprises a cleaning unit having a cleaning member, and a container spaced apart from the cleaning unit, the waste toner container contains the waste toner transferred from the cleaning unit by a waste toner transporting member, and a gap between the side walls of the recessed portion gradually increases in the front-to-back direction from the cleaning unit toward the container of the waste toner container.

18. The apparatus of claim 17, further comprising:

a rotation member located in the container and comprising an eccentricity unit to rotate along an eccentric path with respect to a center of rotation of the rotation member, wherein the housing comprises a support unit of which at least a part thereof is inclined upward toward the container of the waste toner container from the cleaning unit, and the waste toner transporting member comprises a support protrusion that contacts the support unit by sliding, an end part of the waste toner transporting member being connected to the eccentricity unit and moving back and forth and upward and downward due to a rotation of the rotation member.

19. The apparatus of claim 18, wherein the waste toner transporting member comprises a plurality of horizontal ribs that are spaced apart from each other in the front-to-back direction, the spaces between the plurality of horizontal ribs defining a plurality of spaces to transport the waste tone, and widths of the spaces gradually decrease in the front-to-back direction from the cleaning unit toward the container.

20. The apparatus of claim 15, further comprising a customer replaceable unit monitor (CRUM) unit comprising a central processing unit (CPU) which performs at least one of authentication and encrypted data communication with the main body of the image forming apparatus by using its own operating system (0/S).

21. The apparatus of claim 15, wherein the housing comprises a toner container containing toner, a developing portion in which a developing roller for supplying toner to the photoconductor is located, and a toner supply window connecting the toner container to the developing portion, and the developer comprises:

a pair of rails disposed on the toner supply window that extend in a side-to-side lengthwise direction of the developing roller; and a blocking member comprising a blocking portion which opens/closes the toner supply window by being inserted into or removed from the pair of rails from the outside of the housing via an insertion hole located on an outer sidewall of the housing to be aligned with the rails.

22. The apparatus of claim 21, wherein the blocking member comprises a bent portion extended from the blocking portion and disposed at the outside of the housing while the blocking portion is inserted in the rails.

23. The apparatus of claim 22, wherein the developer further comprises a customer replaceable unit monitor (CRUM) unit comprising a central processing unit (CPU) which performs at least one of authentication and encrypted data communication with the main body of the image forming apparatus by using its own operating system (O/S), and the CRUM unit is exposed to the outside via the outer sidewalls of the housing to electrically connect to the main body of the image forming apparatus and the bent portion covers the CRUM unit while the blocking portion is inserted in the rails.

24. The apparatus of claim 23, wherein the bent portion is bent parallel to the outer sidewalls of the housing.

25. The apparatus of claim 23, wherein the bent portion is divided from the blocking portion by a bending line and is bent parallel to the outer sidewalls of the housing along the bending line.

26. The apparatus of claim 23, further comprising a securing portion disposed on the outer sidewalls of the housing, the securing portion securing the bent portion while the blocking portion covers the CRUM unit.

27. A developer unit, comprising:

a photoconductor to form an image thereon;

a housing including a waste toner container to receive waste toner from the photoconductor; and a support member to transmit the waste toner from the photoconductor to the waste toner container, wherein the housing includes an upper wall to cover at least portions of the photoconductor, the support member, and the waste toner container, and the upper wall includes a substantially planar surface and a recessed portion recessed inward from the plane of the substantially planar surface to be closer to the support member than the substantially planar surface, the recessed portion located at a portion of a center of the upper wall in a lengthwise direction, the lengthwise direction corresponding to an end-to-end length of the photoconductor.

28. The developer unit according to claim 27, wherein a length of a gap separating side walls of the recessed portion in the lengthwise direction decreases in a downward direction toward the support member.

29. The developer unit according to claim 28, wherein the side walls of the recessed portion have one of a convex and a concave shape in a downward direction.

30. The developer unit according to claim 27, wherein a length of a gap separating side walls of the recessed portion in the lengthwise direction increases in a front-to-back direction from the photoconductor towards the waste toner container.

31. The developer unit according to claim 30, wherein the side walls of the recessed portion have one of a convex and a concave shape in the lengthwise direction.

32. The developer unit according to claim 27, wherein a bottom surface of the recessed portion has one of a convex and a concave shape in a downward direction toward the support member.

33. The developer unit according to claim 27, wherein a widest point of the recessed portion in the lengthwise direction of the photoconductor has a width less than a length of the photoconductor in the lengthwise direction.

34. An image-forming apparatus, comprising:

an exposing unit to emit a light; and a developer unit to receive the light from the exposing unit and to apply a toner to a recording medium according to the received light, wherein the developer unit comprises:

a photoconductor to form an image thereon;

a housing including a waste toner container to receive waste toner from the photoconductor; and a support member to transmit the waste toner from the photoconductor to the waste toner container, wherein the housing includes an upper wall to cover at least portions of the photoconductor, the support member, and the waste toner container, and the upper wall includes a substantially planar surface and a recessed portion recessed inward from the plane of the substantially planar surface to be closer to the support member than the substantially planar surface, the recessed portion located at a portion of a center of the upper wall in a lengthwise direction, the lengthwise direction corresponding to an end-to-end length of the photoconductor.

* * * * *